US009620053B2

(12) United States Patent
Kim et al.

(10) Patent No.: US 9,620,053 B2
(45) Date of Patent: Apr. 11, 2017

(54) THRESHOLD VOLTAGE SENSING CIRCUIT OF ORGANIC LIGHT-EMITTING DIODE DISPLAY DEVICE

(71) Applicant: SILICON WORKS CO., LTD., Daejeon-si (KR)

(72) Inventors: Ji-Hun Kim, Daejeon-si (KR); Hae-Won Lee, Cheongju-si (KR); Kyoung-Jik Min, Seoul (KR); Yeong-Joon Son, Daejeon-si (KR)

(73) Assignee: SILICON WORKS CO., LTD., Daejeon-si (KR)

( * ) Notice: Subject to any disclaimer, the term of this patent is extended or adjusted under 35 U.S.C. 154(b) by 288 days.

(21) Appl. No.: 14/369,223

(22) PCT Filed: Dec. 28, 2012

(86) PCT No.: PCT/KR2012/011695

§ 371 (c)(1),
(2) Date: Jun. 27, 2014

(87) PCT Pub. No.: WO2013/100686

PCT Pub. Date: Jul. 4, 2013

(65) Prior Publication Data

US 2014/0368415 A1 Dec. 18, 2014

(30) Foreign Application Priority Data

Dec. 30, 2011 (KR) ..... 10-2011-0146978

(51) Int. Cl.
*G09G 3/30* (2006.01)
*G09G 3/3208* (2016.01)
*G09G 3/3233* (2016.01)

(52) U.S. Cl.
CPC ..... *G09G 3/3208* (2013.01); *G09G 3/3233* (2013.01); *G09G 2300/0842* (2013.01);
(Continued)

(58) Field of Classification Search
CPC ..... G09G 3/3208; G09G 3/3233; G09G 2320/0295; G09G 2320/045; G09G 3/3291; G11C 27/02
USPC ..... 345/77; 341/118
See application file for complete search history.

(56) References Cited

U.S. PATENT DOCUMENTS 7,106,229 B1 * 9/2006 Chew ..... H03M 1/0604 341/118
8,681,110 B2 * 3/2014 Huang ..... G06F 3/044 178/18.06

(Continued)

FOREIGN PATENT DOCUMENTS

CN 1477862 2/2004
CN 1885394 12/2006

(Continued)

OTHER PUBLICATIONS

International Search Report for International Application No. PCT/KR2012/011695, dated Apr. 23, 2013.

*Primary Examiner* — Chanh Nguyen
*Assistant Examiner* — Yuzhen Shen
(74) *Attorney, Agent, or Firm* — Kile Park Reed & Houtteman PLLC

(57) ABSTRACT

The present invention relates to a technique for outputting threshold voltages by properly changing the threshold voltages such that the threshold voltages can protect low-voltage driving elements within an analog to digital converter when the threshold voltages of an OLED display panel are sensed and outputted to the analog to digital converter. The present invention comprises: a sampling capacitor which samples threshold voltages sensed and inputted from an organic light-emitting diode on a display panel; a charge-sharing capacitor which charges and shares the threshold voltages sampled from the sampling capacitor, or solely charges the threshold voltages to bypass the threshold voltages; and a sample-and-hold unit which has a plurality of switches for performing switching operations for the sampling operation of the sampling capacitor and the charging and the sharing of the charge-sharing capacitor, and scales the threshold voltages to threshold voltage areas having a certain value or less.

11 Claims, 22 Drawing Sheets

(52) U.S. Cl.
CPC ..... *G09G 2310/0289* (2013.01); *G09G 2310/0294* (2013.01); *G09G 2320/0233* (2013.01); *G09G 2320/0295* (2013.01); *G09G 2320/045* (2013.01)

(56) References Cited

U.S. PATENT DOCUMENTS

| | | | | |
|---|---|---|---|---|
| 2006/0232577 | A1* | 10/2006 | Edwards | G09G 3/3648 345/211 |
| 2008/0252633 | A1 | 10/2008 | Kim | |
| 2009/0243907 | A1* | 10/2009 | Nazemi | H03M 1/1042 341/161 |
| 2011/0102410 | A1* | 5/2011 | Cho | G09G 3/3291 345/212 |
| 2011/0303846 | A1* | 12/2011 | Thorne | G01J 1/44 250/332 |
| 2012/0071122 | A1* | 3/2012 | Akita | G11C 27/024 455/130 |

FOREIGN PATENT DOCUMENTS

| | | |
|---|---|---|
| CN | 101796823 | 8/2010 |
| JP | 2004-112741 | 4/2004 |
| JP | 2009-101582 | 5/2009 |
| KR | 10-2004-0010299 | 1/2004 |
| KR | 10-2008-0085575 | 9/2008 |
| KR | 10-2010-0038445 | 4/2010 |
| KR | 10-2011-0047359 | 5/2011 |
| WO | 2009/031303 | 3/2009 |

* cited by examiner

Fig. 21

(a)

| SENSING VOLTAGE RANGE | INPUT CONDITION (V) |
|---|---|
| Δ3 | 5~8 |
| | 4~7 |
| | 3~6 |
| | 2~5 |

(b)

| SENSING VOLTAGE RANGE | INPUT CONDITION (V) |
|---|---|
| Δ2 | 6~8 |
| | 5~7 |
| | 4~6 |
| | 3~5 |
| | 2~4 |

(c)

| SENSING VOLTAGE RANGE | INPUT CONDITION (V) |
|---|---|
| Δ1 | 7~8 |
| | 6~7 |
| | 5~6 |
| | 4~5 |
| | 3~4 |
| | 2~3 |

THRESHOLD VOLTAGE SENSING CIRCUIT OF ORGANIC LIGHT-EMITTING DIODE DISPLAY DEVICE

BACKGROUND OF THE INVENTION

Field of the Invention

The present invention relates to a threshold voltage sensing circuit of an organic light-emitting diode (OLED) display device, and more particularly, to a threshold voltage sensing circuit of an OLED display device, which changes the threshold voltage of an OLED to a voltage suitable for protecting a low-voltage driving element in an analog-to-digital converter, when sensing the threshold voltage of the OLED and outputting the sensed threshold voltage to the analog-to-digital converter.

Description of the Related Art

In general, a display panel of an OLED display device includes a plurality of pixels arranged in a matrix shape, and each of the pixels includes an OLED. When a signal is supplied to a gate line, each of the pixels is turned on by a data signal supplied from a data line, and emits light. The unit pixels of the display panel include OLEDs arranged therein and showing a unique color of red, green, and blue. The colors of the OLEDs may be combined to express a target color.

However, since the OLEDs on the display panel gradually deteriorate with time, the threshold values thereof are changed. Thus, although the same driving current is supplied to the OLEDs, the brightness of the OLEDs may be gradually changed with time.

Thus, the threshold voltages of the OLEDs may be sensed and stored in a memory. When a data signal is outputted to the display panel, the data signal may be compensated for according the changes of the threshold voltages based on the stored threshold voltages. Therefore, the OLEDs may maintain constant brightness at all times, regardless of the use time of the OLEDs.

FIG. 1 is a block diagram of a conventional threshold voltage sensing device of an OLED display device. As illustrated in FIG. 1, the conventional threshold voltage sensing device includes a display panel 10, a gate driver 20, a source driver 30, and a threshold voltage sensing controller 40.

Each of pixels arranged in the display panel 10 includes a switching transistor TFT-S which transmits a data signal to a driving transistor TFT-D through data lines DL1 to DLn of the source driver 30. The driving transistor TFT-D supplies a driving current corresponding to the data signal supplied through the switching transistor TFT-S to the corresponding OLED. A capacitor C coupled between one terminal and the gate of the driving transistor TFT-D and maintains the turn-on state of the driving transistor TFT-D during one frame, the corresponding OLED may maintain the light-emitting state during one frame.

Before the system is powered on to display an image on the display panel 10 or in a threshold voltage sensing mode, the threshold voltage sensing controller 40 sequentially outputs a control signal to threshold voltage compensation control lines CL1 to CLn. Thus, threshold voltage sensing transistors TFT-V of a corresponding horizontal line are sequentially turned on.

When the control signal is supplied to the first threshold voltage compensation control line CL1 to turn on the threshold voltage sensing transistors TFT-V, the source driver 30 transmits precharge voltages to the data lines DL1 to DLn through buffers BUF1 to BUFn, respectively. At this time, the precharge voltages are supplied to the anodes of the OLEDs, respectively.

Then, when the precharge voltages of the OLEDs are sufficiently discharged, sample and hold circuits SH1 to SHn sample and hold the threshold voltages Vth of the OLEDs, sensed through the threshold voltage sensing transistors TFT-V and the corresponding data lines DL, respectively. The analog threshold voltages Vth sampled and held through the sample and hold circuits SH1 to SHn are converted into digital signals through an analog-to-digital converter 31, and stored in a memory.

Subsequently, the same operation is repeated on the next horizontal line. Whenever the same operation is repeated on each horizontal line, the threshold voltages of the OLEDs are converted into digital signals and stored in the memory.

In an image display mode, when data signals are outputted to the OLEDs, the data signals may be compensated for as much as the changes of the threshold voltages based on the threshold voltages stored in the memory. Thus, the OLEDs maintain the constant brightness regardless of the changes of the threshold voltages.

However, since the sample and hold circuits SH1 to SHn and the analog-to-digital converter 31 perform a digital logical circuit operation, the sample and hold circuits SH1 to SHn and the analog-to-digital converter 31 are typically implemented with transistors which are driven at a low voltage. Thus, when a threshold voltage is sensed and transmitted to the analog-to-digital converter 31, the PN-junction diode of the transistor (for example, LV PMOS transistor) may be turned on in case where the threshold voltage is higher than the limit voltage (for example, VDD+Vth) which guarantees stable operations of the transistors within the analog-to-digital converter 31. Thus, a discharge operation may occur due to leakage current in the analog-to-digital converter 31.

Nevertheless, the conventional threshold voltage sensing device does not include a function of changing or limiting a sampled and held threshold voltage to the limit voltage or less, which guarantees the stable operations of the transistors within the analog-to-digital converter. Thus, a discharge operation may be caused by leakage current, and the values of the threshold voltages sensed from the OLEDs may not be normally stored in the memory.

SUMMARY OF THE INVENTION

Accordingly, the present invention has been made in an effort to solve the problems occurring in the related art, and an object of the present invention is to provide a threshold voltage sensing circuit of an OLED display device, which is capable of scaling down threshold voltages sensed from OLEDs of a display panel to threshold voltages within a predetermined range through charge sharing, when the threshold voltages are sampled and held and then transmitted to an analog-to-digital converter (ADC).

In order to achieve the above object, according to one aspect of the present invention, a threshold voltage sensing circuit of an OLED display device including an OLED may include: a sampling capacitor configured to sample a threshold voltage of the OLED; a charge-share capacitor configured to charge-share the voltage sampled in the sampling capacitor; and a comparator configured to compare the variation range of the threshold voltage to a reference value, wherein when the variation range of the threshold voltage is larger than the reference value, the threshold voltage is stored in the sampling capacitor and the charge-share capacitor to make the variation range of the threshold voltage smaller than the reference value.

According to another aspect of the present invention, a threshold voltage sensing circuit of an OLED display device including an OLED may include: a sampling capacitor configured to sample a threshold voltage of the OLED; a charge-share capacitor configured to charge-share the voltage sampled in the sampling capacitor; an amplification section configured to variably amplify the threshold voltage outputted from the charge-share capacitor; and a comparator configured to compare the variation range of the threshold voltage to a reference value, wherein when the variation of the threshold voltage is larger than the reference value, the threshold voltage is stored in the sampling capacitor and the charge-share capacitor to make the variation range of the threshold voltage smaller than the reference value, and then transmitted to the amplification section.

According to another aspect of the present invention, a threshold voltage sensing circuit of an OLED display device including an OLED may include: a sampling capacitor configured to sample a threshold voltage of the OLED; one or more charge-share capacitors configured to charge-share the voltage sampled in the sampling capacitor; and a comparator configured to compare the variation range of the threshold voltage to a reference value, wherein when the variation range of the threshold voltage is larger than the reference value, the threshold voltage is stored in the sampling capacitor and the charge-share capacitor to make the variation range of the threshold voltage smaller than the reference value.

BRIEF DESCRIPTION OF THE DRAWINGS

The above objects, and other features and advantages of the present invention will become more apparent after a reading of the following detailed description taken in conjunction with the drawings, in which:

FIGS. 21A to 21C are diagrams showing sensing voltage ranges and input conditions in FIGS. 18 to 20.

DETAILED DESCRIPTION OF PREFERRED EMBODIMENTS

Through the specification, when an element is referred to as being 'electrically coupled', 'coupled', or 'connected' between other elements, it may indicate that the elements are directly coupled or connected to each other or indirectly coupled or connected to each other through an intermediate medium, while each of the elements maintains its property to some extent or more. Furthermore, when a signal is referred to as being 'transmitted' or 'derived', it may indicate that the signal is directly transmitted or derived or indirectly transmitted or derived through an intermediate medium, while the signal maintains its property to some extent or more. Furthermore, when a voltage or signal is referred to as being 'applied' or 'inputted', it may indicate that the signal is directly applied or inputted or indirectly applied or inputted through an intermediate medium.

Furthermore, plural expressions of each element may be omitted. For example, although an element includes a plurality of switches or a plurality of signal lines, the plurality of switches or signal lines may be represented as 'switches' or 'signal lines' or 'switch' or 'signal line'. This is because the switches may complementarily operate or independently operate depending on cases, and when a plurality of signals having the same property, for example, data signal lines are provided as a bundle of signals lines, the signal lines do not need to be divided into singular and plural forms. Thus, throughout the specification, similar expressions may be analyzed in the same manner.

The advantages and purpose accomplished by embodiments of the present invention will be understood with reference to the following descriptions and the accompanying drawings.

Hereafter, the embodiments of the present invention will be described in detail with reference to the accompanying drawings.

Figure 1:
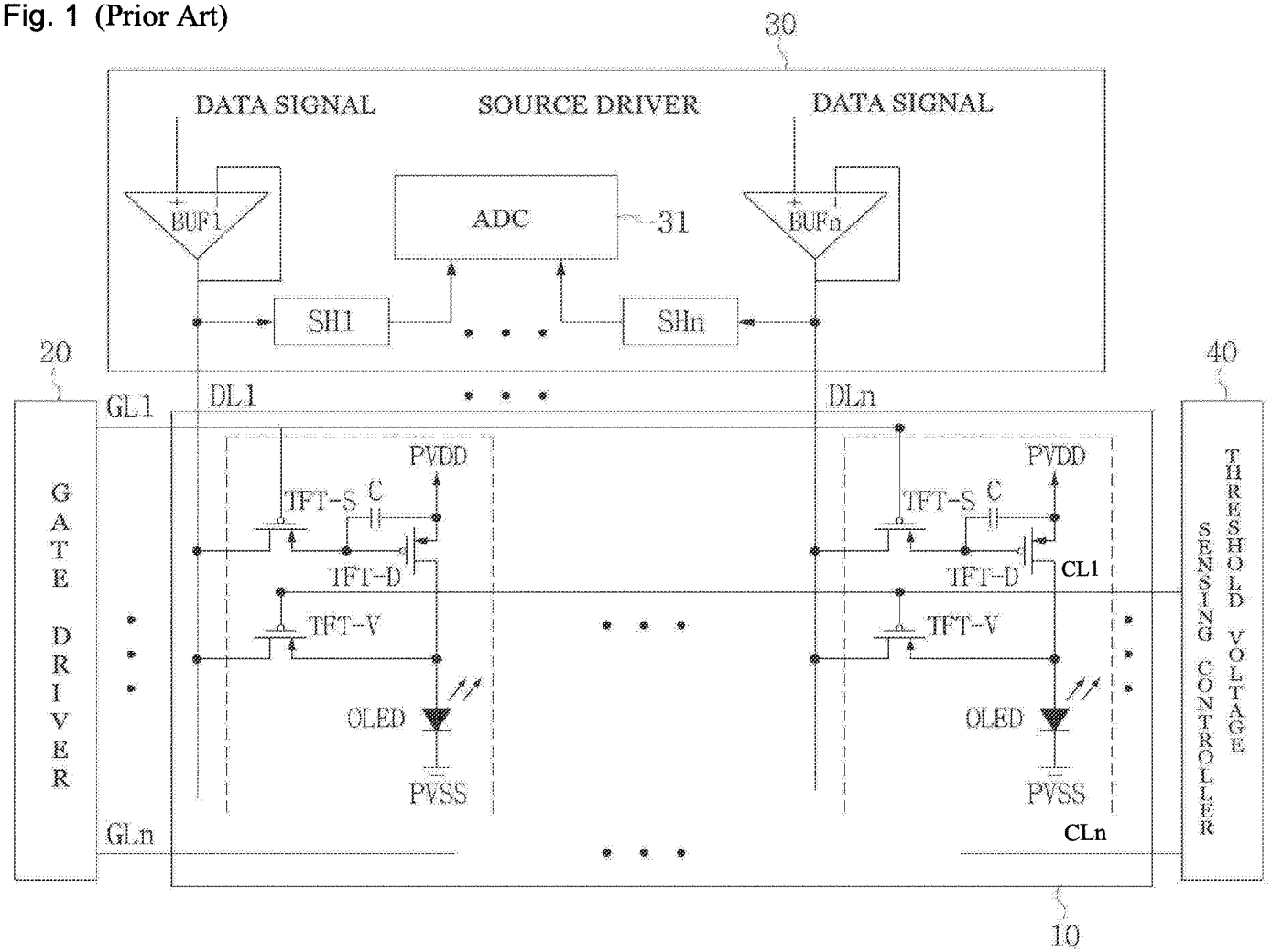
Fig. 1 (Prior Art)
FIG. 1 is a block diagram of a conventional threshold voltage sensing device of an OLED display device.
Figure 2:
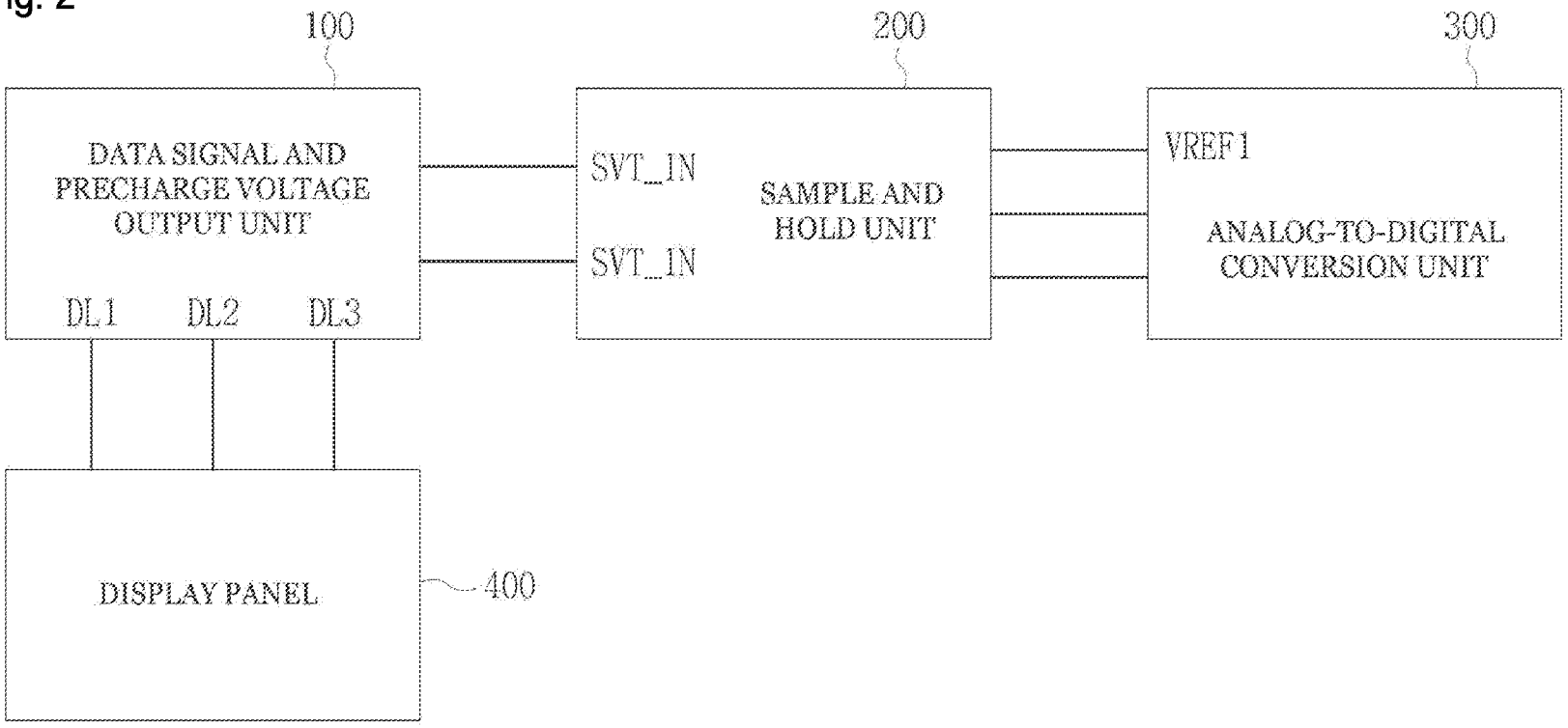
FIG. 2 is the entire block diagram of a threshold voltage sensing circuit of an organic light emitting diode (OLED) display device according to a first embodiment of the present invention.
Figure 3:
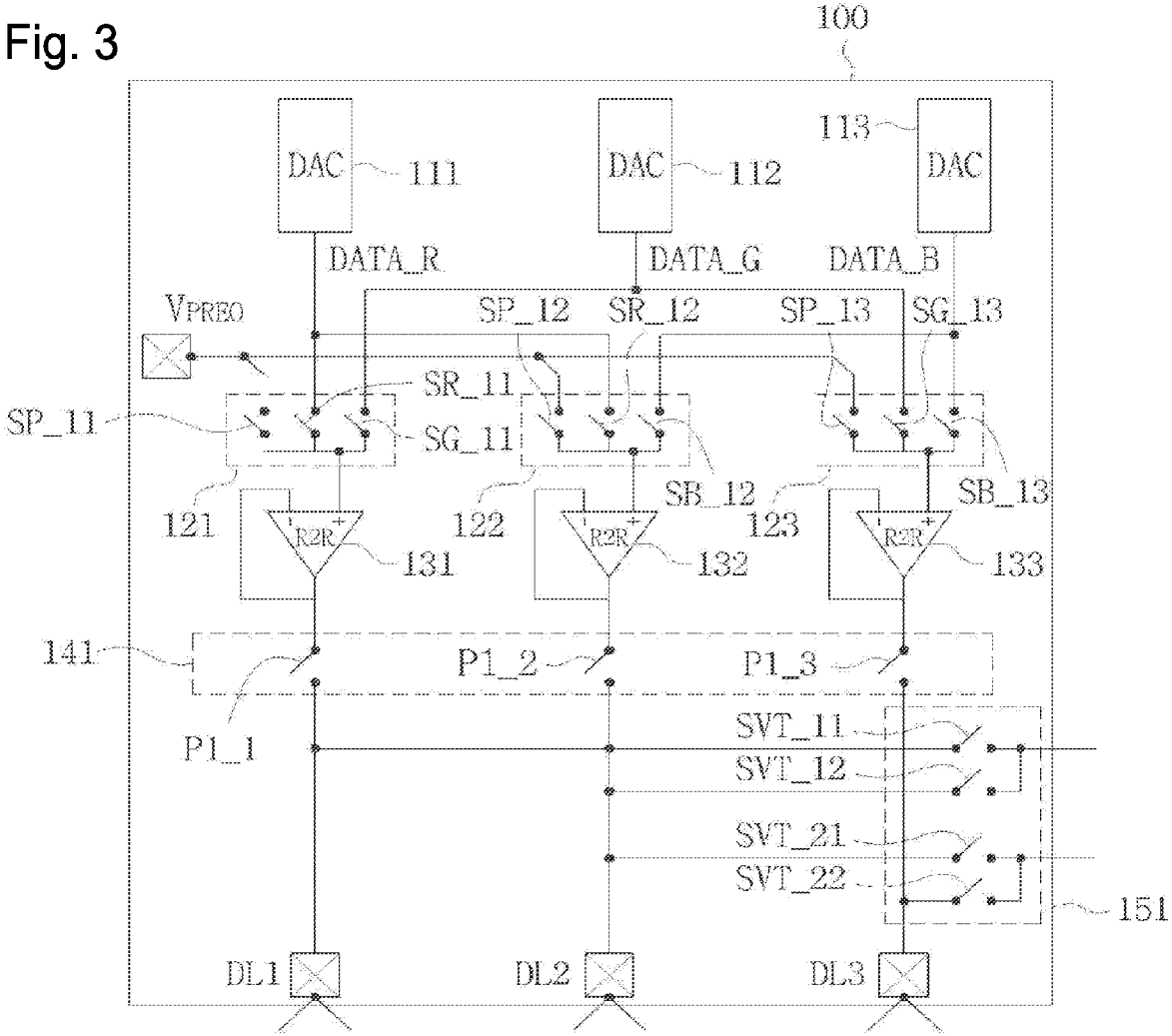
FIGS. 3 to 5 are detailed circuit diagrams of respective units of FIG. 2.
Figure 4:
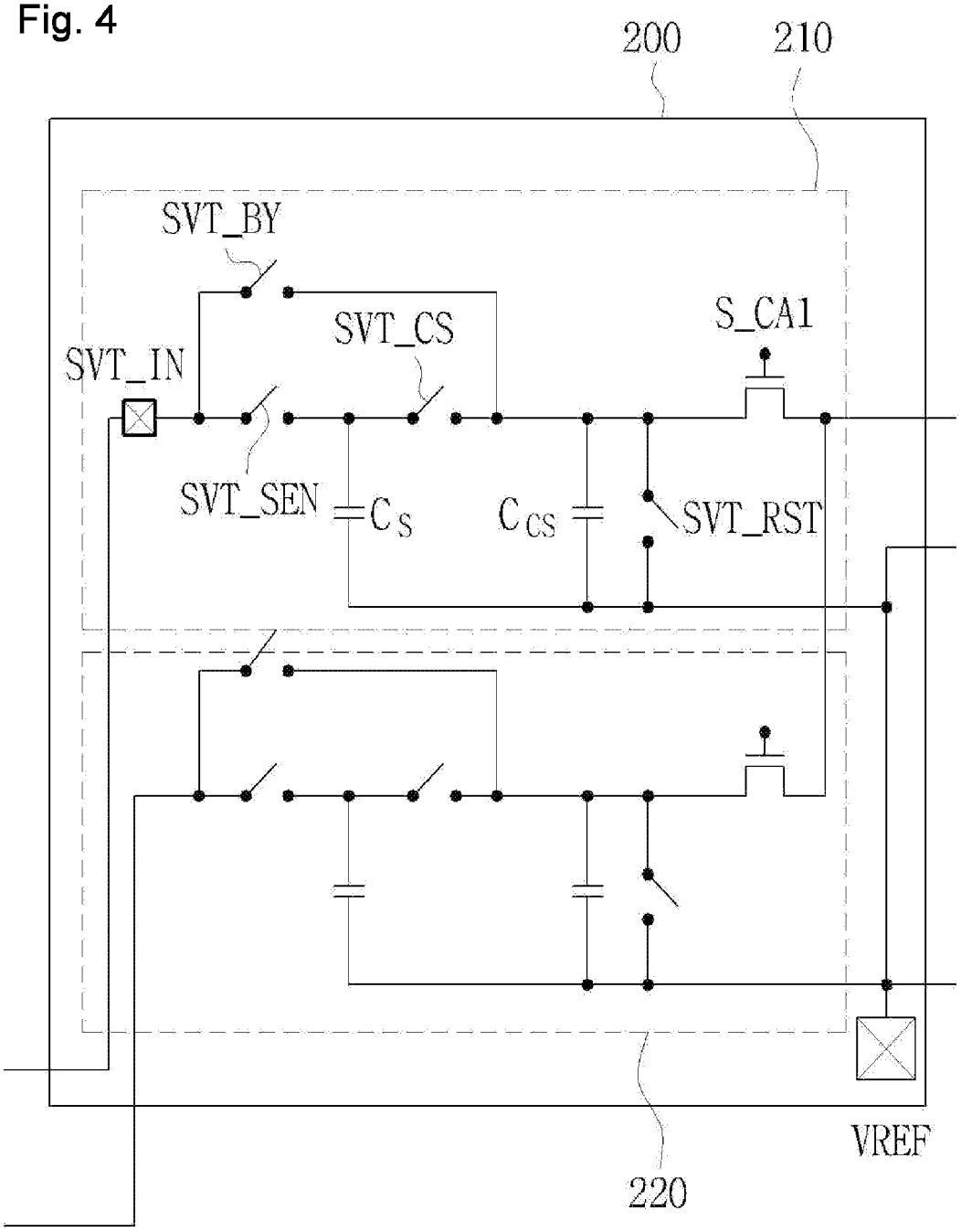
Figure 5:
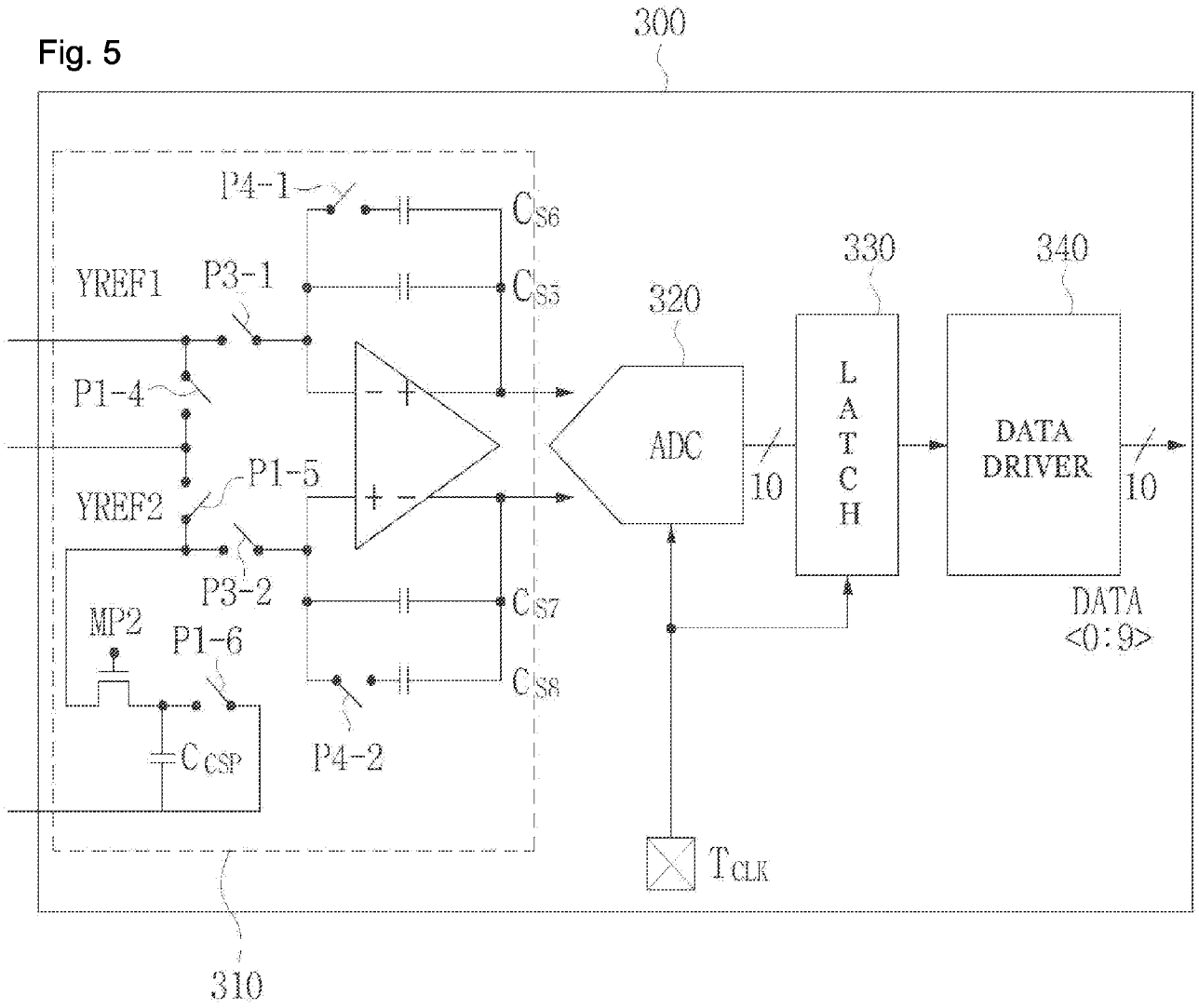

FIG. 2 is the entire block diagram of a threshold voltage sensing circuit of an organic light emitting diode (OLED) display device according to a first embodiment of the present invention. The threshold voltage sensing circuit includes a data signal and precharge voltage output unit 100, a sample and hold unit 200, and an analog-to-digital conversion unit 300. FIGS. 3 to 5 are detailed circuit diagrams of the respective units.

The installation positions of the data signal and precharge voltage output unit 100, the sample and hold unit 200, and the analog-to-digital conversion unit 300 are not limited, but may be installed within a source driver for driving a display panel 400.

Referring to FIGS. 2 to 5, the embodiment of the present invention will be described in detail.

The data signal and precharge voltage output unit 100 includes first to third digital to analog converters (DAC) 111 to 113, the first to third switch sections 121 to 123, first to third buffers 131 to 133, an output signal control section 141, and a threshold voltage sensing switch 151.

In an image display mode for the display panel 400, the first to third DACs 111 to 113 output a red data signal DATA_R, a green data signal DATA_G, and a blue data signal DATA_B, respectively.

The first to third switch sections 121 to 123 include a plurality of switches SP_11, SR_11, and SG_11, a plurality of switches SP_12, SR_12, and SG_12, and a plurality of switches SP_13, SR_13, and SG_13, respectively. The first switch section 121 selects and outputs the red data signal DATA_R through the first-first red switch SR_11 or selects and outputs the green data signal DATA_G through the first-first green switch SG_11 in the image display mode, and selects and outputs a threshold voltage detection precharge voltage $V_{PRE0}$ through the first-first output switch SP_11 in a threshold voltage sensing mode.

The second switch section 122 selects the red data signal DATA_R through the first-second red switch SR_12 or selects and outputs the blue data signal DATA_B through the first-second blue switch SB_12 in the image display mode, and selects and outputs the threshold voltage detection precharge voltage $V_{PRE0}$ through the first-second output switch SP_12 in the threshold voltage sensing mode.

The third switch section 123 selects and output the red data signal DATA_G through the first-third green switch SG_13 or selects and outputs the blue data signal DATA_B through the first-third blue switch SB_13 in the image display mode, and selects and outputs the threshold voltage detection precharge voltage $V_{PRE0}$ through the first-third output switch SP_13 in the threshold voltage sensing mode.

The first to third buffers 131 to 133 buffer a corresponding output signal among output signals of the first to third switch sections 121 to 123.

The output signal control section 141 includes the first to third output signal control switches P1_1 to P1_3 for controlling signals which are outputted to data lines DL1 to DL3 from the first to third buffers 131 to 133.

The threshold voltage sensing switch 151 selectively receives threshold voltages sensed from a corresponding pixel, after the threshold voltage detection precharge voltage $V_{PRE0}$ is supplied to the OLED of the pixel. For this operation, the threshold voltage sensing switch 151 includes threshold voltage sensing switches SVT_11, SVT_12, SVT_21, and SVT_22. The first-first threshold voltage sensing switch SVT_11 selects and outputs a threshold voltage sensed from an arbitrary red OLED or green OLED coupled to the data line DL1. The first-second threshold voltage sensing switch SVT_12 and the second-first threshold voltage sensing switch SVT_21 select and output a threshold voltage sensed from an arbitrary blue OLED or red OLED coupled to the data line DL2. The second-second threshold voltage sensing switch SVT_22 selects and outputs a threshold voltage sensed from an arbitrary green OLED or blue OLED coupled to the data line DL3.

The method of selecting threshold voltages sensed from the OLEDs arranged in each horizontal line on the display panel and transmitting the selected threshold voltages to the sample and hold unit 200 may be implemented in various manners, but the present invention is not limited to a specific method. In the first embodiment of the present invention, a pair of threshold voltages are selected through the first-first to second-second threshold voltage sensing switches SVT_11, SVT_12, SVT_21, and SVT_22, and then transmitted to the sample and hold unit 200.

For example, when the first-first threshold voltage sensing switch SVT_11 selects and outputs a threshold voltage sensed from an arbitrary red OLED coupled to the first data line DL1, the second-first threshold voltage sensing switch SVT_21 selects and outputs a threshold voltage sensed from an arbitrary red OLED coupled to the second data line DL2.

When the first-first threshold voltage sensing switch SVT_11 selects and outputs a threshold voltage sensed from an arbitrary green OLED coupled to the first data line DL1, the second-second threshold voltage sensing switch SVT_22 selects and outputs a threshold voltage sensed from an arbitrary green OLED coupled to the third data line DL3.

When the first-second threshold voltage sensing switch SVT_12 selects and outputs a threshold voltage sensed from an arbitrary blue OLED coupled to the second data line DL2, the second-second threshold voltage sensing switch SVT_22 selects and outputs a threshold voltage sensed from an arbitrary blue OLED coupled to the third data line DL3.

For reference, on the display panel 400, a MOS transistor M_R for red serves to transmit the threshold voltage sensed from the red OLED to the corresponding data line. A MOS transistor M_G for green and a MOS transistor M_B for blue perform the same operation.

The sample and hold unit 200 includes first and second sample and hold sections 210 and 220 corresponding to a pair of threshold voltages inputted from the data signal and precharge voltage output unit 100. The second sample and hold section 220 serves to provide a differential input to the sample and hold unit 200, and has the same configuration as the first sample and hold section 210. Thus, the following descriptions will be focused on the first sample and hold section 210, for convenience of description.

The first sample and hold section 210 includes a sensing switch SVT_SEN, a sampling capacitor $C_S$, a charge-share switch SVT_CS, a bypass switch SVT_BY, a charge-share capacitor $C_{CS}$, a reset switch SVT_RST, a MOS transistor S_CA1, and a reference voltage source VREF.

The sensing switch SVT_SEN is coupled between a sensing voltage input terminal SVT_IN and one terminal of the sampling capacitor $C_S$, and transmits a threshold voltage sensed from a corresponding OLED on the display panel 400 to the sampling capacitor $C_S$. The sampling capacitor $C_S$ is coupled between the other terminal of the sensing switch SVT_SEN and the reference voltage source VREF, and samples a threshold voltage inputted through the sensing switch SVT_SEN.

The charge-share switch SVT_CS is coupled between the one terminal of the sampling capacitor $C_S$ and one terminal of the charge-share capacitor $C_{CS}$, and transmits the sampled threshold voltage to the charge-share capacitor $C_{CS}$.

The bypass switch SVT_BY is coupled between a sensing voltage input terminal SVT_IN and the one terminal of the charge-share capacitor $C_{CS}$, and transmits the sensed threshold voltage to the charge-share capacitor $C_{CS}$.

The charge-share capacitor $C_{CS}$ is coupled between the reference voltage source VREF and the other terminals of the charge-share switch SVT_CS and the bypass switch SVT_BY, and charge-shares the threshold voltage stored in the sampling capacitor $C_S$ or temporarily stores the threshold voltage inputted through the bypass switch SVT_BY and bypasses the threshold voltage.

The reset switch SVT_RST is coupled in parallel to both terminals of the charge-share capacitor $C_{CS}$, and resets the voltage stored in the charge-share capacitor $C_{CS}$.

The MOS transistor S_CA1 is coupled between one terminal of the charge-share capacitor $C_{CS}$ and the analog-to-digital conversion unit 300, and transmits the threshold voltage stored in the charge-share capacitor $C_{CS}$ to the analog-to-digital converter 300.

The reference voltage source VREF is coupled between the ground terminal and the other terminals of the sampling capacitor $C_S$ and the charge-share capacitor $C_{CS}$, and supplies a predetermined reference voltage to the other terminals of the sampling capacitor $C_S$ and the charge-share capacitor $C_{CS}$.

When the first sample and hold section 210 samples and holds the sensed threshold voltages inputted through the data signal and precharge voltage output unit 100 and outputs the sampled and held threshold voltages to the analog-to-digital conversion unit 300 at the next stage, the first sample and hold section 210 may scale down the threshold voltages to threshold voltages having a variation within a predetermined range through charge sharing.

For example, when the variation ranges of the threshold voltages inputted to the first sample and hold section 210 correspond to Δ4V, Δ2.7V, Δ1.5V, and Δ1V, respectively, the first sample and hold section 210 scales down the threshold voltages of Δ4V and Δ2.7V using a scale factor of 0.375, and outputs threshold voltages of Δ1.5 and Δ1V, respectively. Furthermore, the first sample and hold section 210 bypasses the threshold voltages of Δ1.5V and Δ1V without scaling. Here, 'Δ' represents the variation range of a voltage. For example, 'Δ4V' may indicate that the corresponding voltage has a variation range of 4V. In the following descriptions, 'Δ' will be used as the same meaning.

The second sample and hold section 220 serves to supply a differential input to the analog-to-digital conversion unit 300, and performs the same operation as the first sample and hold section 210. Thus, the detailed descriptions thereof are omitted therein. As a result, the first sample and hold section 210 may output threshold voltages having a variation range of Δ1.5V to Δ1V, even though threshold voltages having various variation ranges are inputted. Such a process will be described with reference to FIGS. 6 to 12.

Figure 8:
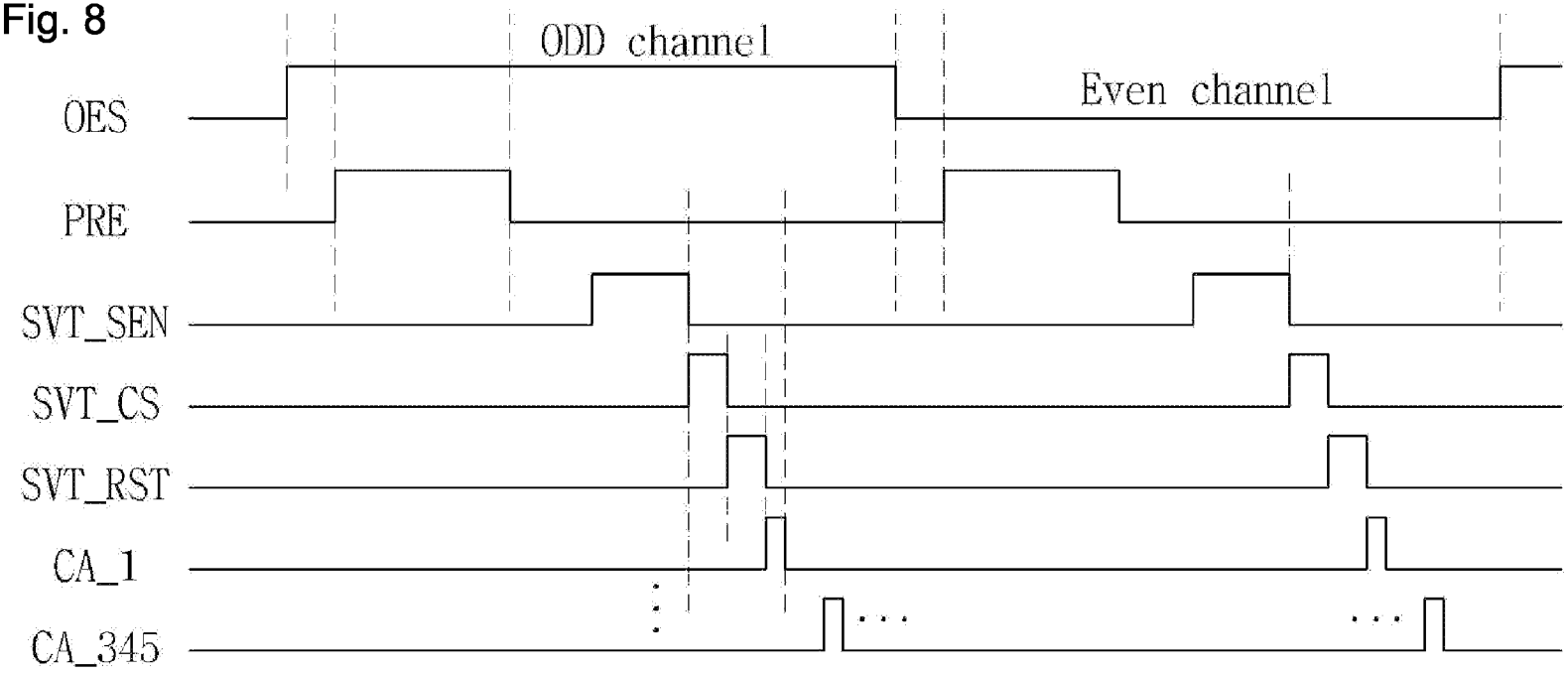
FIG. 8 is a timing diagram of the first sample and hold section of FIG. 4.

First, as illustrated in FIG. 8, precharge and sensing operations are performed on the OLEDs arranged on the display panel 400 of FIG. 2 according to a precharge signal PRE and a sensing signal SEN. In FIG. 8, a channel select signal OES is used to determine whether to select unit pixels belonging to an odd channel on the display panel 400 or unit pixels belonging to an even channel on the display panel 400. While the precharge signal PRE is activated, the precharge operation is performed. When the precharge operation is ended, the sensing switch SVT_SEN, the charge-share switch SVT_CS, and the reset switch SVT_RST are sequentially turned on. The first to 345th switching signals CA_1 to CA_345 indicate that 345 sample and hold operations are sequentially performed on the analog-to-digital conversion unit 300.

Figure 9:
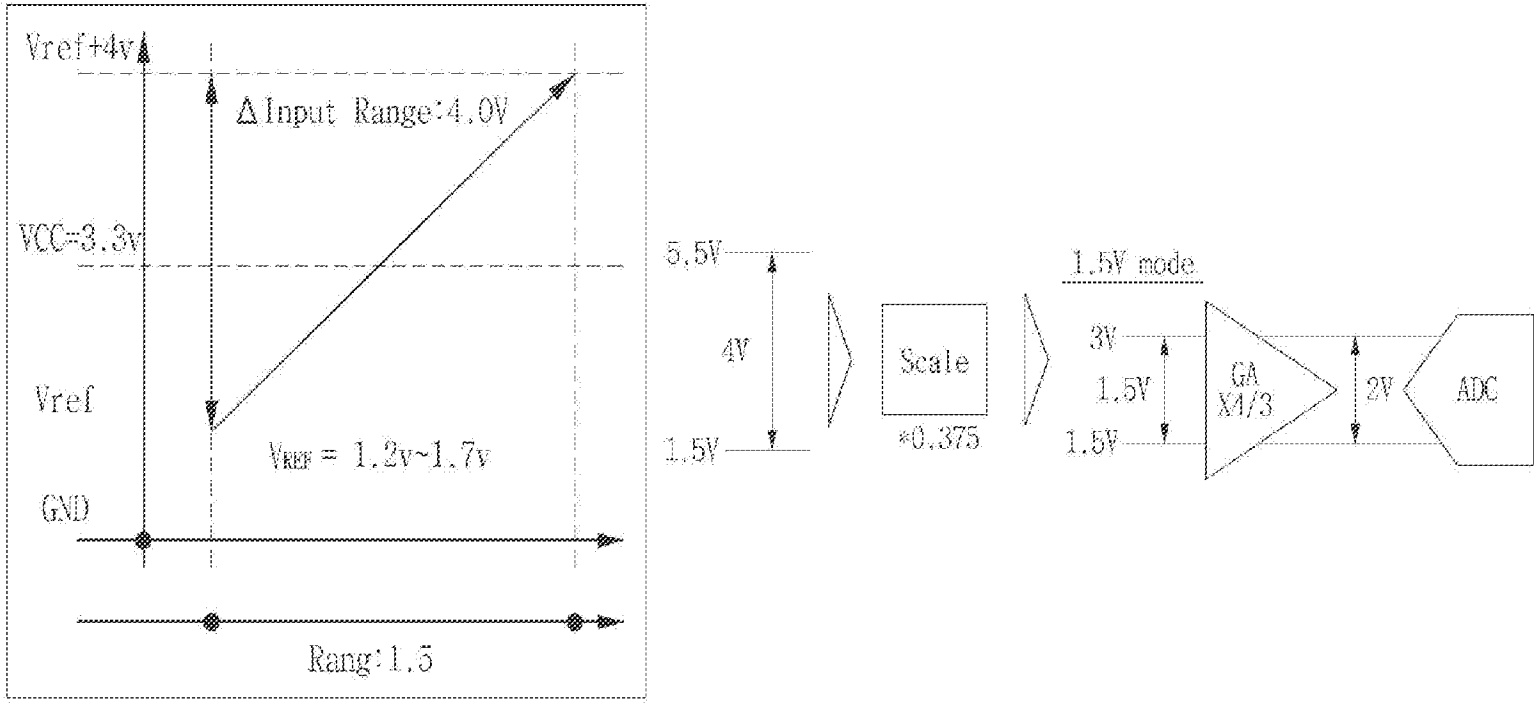
FIGS. 9 to 12 are diagrams for explaining the operation of the first sample and hold section of FIG. 4.

At this time, when a threshold voltage having a variation of 4V (Δ4V) is transmitted to the sensing voltage input terminal SVT_IN of the first sample and hold section 210 through the first-first threshold voltage sensing switch SVT_11 or the first-second threshold voltage sensing switch SVT_12 from the threshold voltage sensing switch 151 of the data signal and precharge voltage output unit 100, the first sample and hold section 210 is set in the scale mode by a controller (not illustrated), because the variation range of Δ4V is larger than the variation range of a threshold voltage to be outputted through the first sample and hold section 210, that is, the variation range of Δ1.5V to Δ1.0V. Then, the first sample and hold section 210 performs a scaling operation as illustrated in FIG. 9. The controller includes a comparator (not illustrated) configured to compare the variation range of the threshold voltage to a reference value. According to the comparison result of the comparator, the controller performs the scale mode when the variation range of the threshold voltage is larger than the reference value, and performs the bypass mode when the variation range of the threshold voltage is smaller than the reference value. The reference value may be set in the range of 1.2V to 2.2V as in the embodiment of the present invention.

Figure 6:
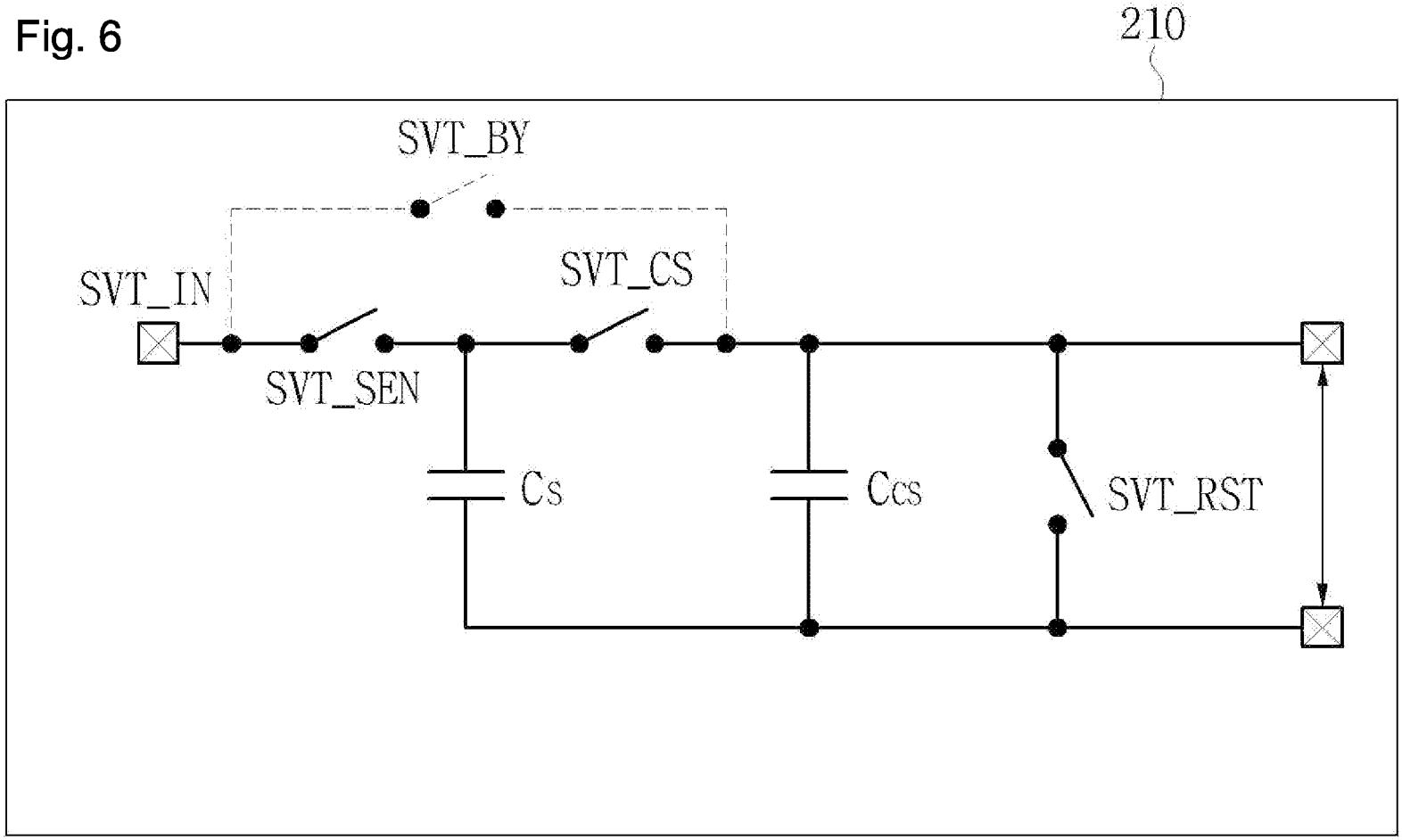
FIGS. 6 and 7 are circuit diagrams for explaining the operation of a first sample and hold section of FIG. 4.

In the scale mode, since the sensing switch SVT_SEN is turned on as illustrated in FIG. 6, the threshold voltage of Δ4V, transmitted to the sensing voltage input terminal SVT_IN, is sampled into the sampling capacitor $C_S$ through the sensing switch SVT_SEN. At this time, a voltage ranging from 1.2V to 1.7V is supplied to the reference voltage source VREF. In the present embodiment, the case in which a voltage of 1.5V is supplied to the reference voltage source VREF will be taken as an example for description.

After the charge voltage of the charge-share capacitor $C_{CS}$ is reset by a turn-on operation of the reset switch SVT_RST, the charge-share switch SVT_CS is then turned on. Thus, the threshold voltage sampled in the sampling capacitor $C_S$ is scaled (divided) by the charge-share capacitor $C_{CS}$. At this time, in order to change the threshold voltage of Δ4V, sampled in the sampling capacitor $C_S$, into a threshold voltage of Δ1.5V, the threshold voltage of Δ4V needs to be scaled down through a scale factor of 0.375. The operation of scaling down the threshold voltage through the scale factor of 0.375 may be accomplished by properly setting the capacitance values of the sampling capacitor $C_S$ and the charge-share capacitor $C_{CS}$.

The threshold voltage of Δ1.5V, scaled down through the above-described process, is outputted to the analog-to-digital conversion unit 300 through the MOS transistor S_CA1.

Figure 10:
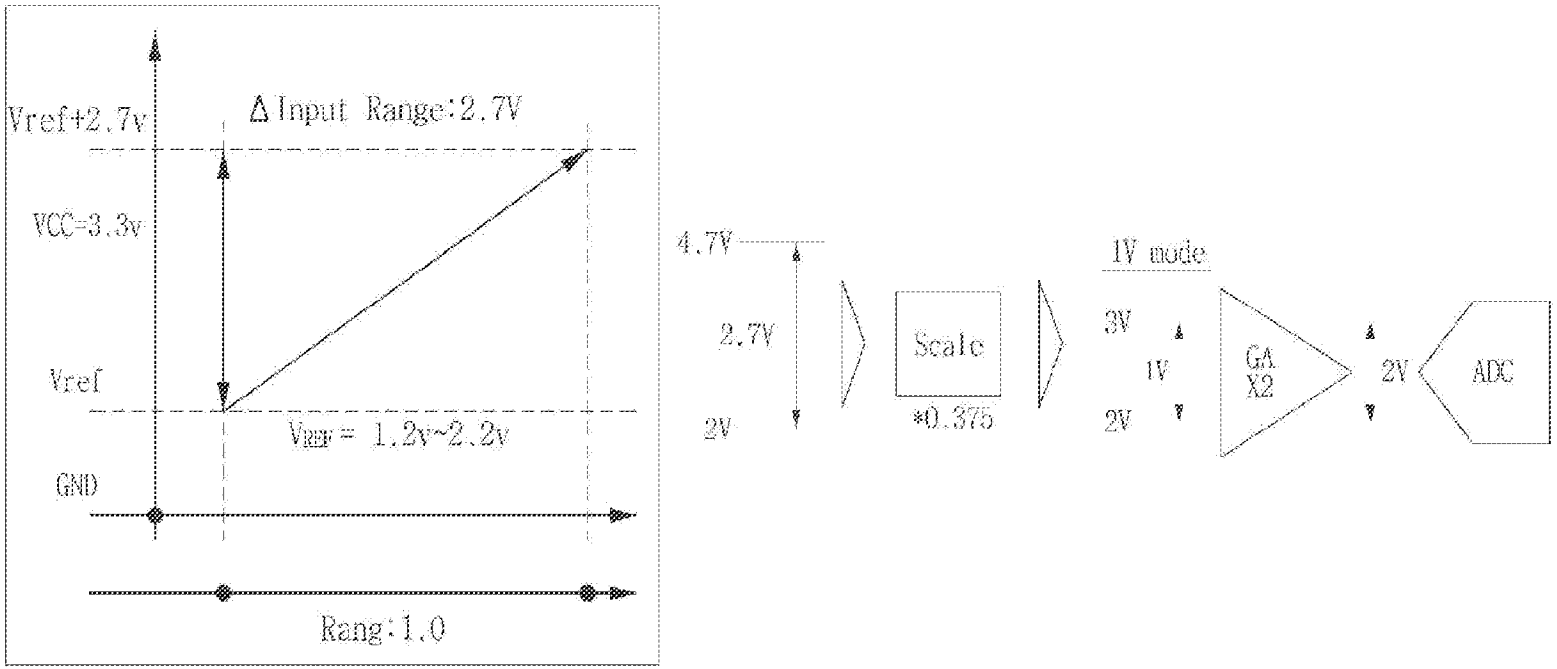
Figure 11:
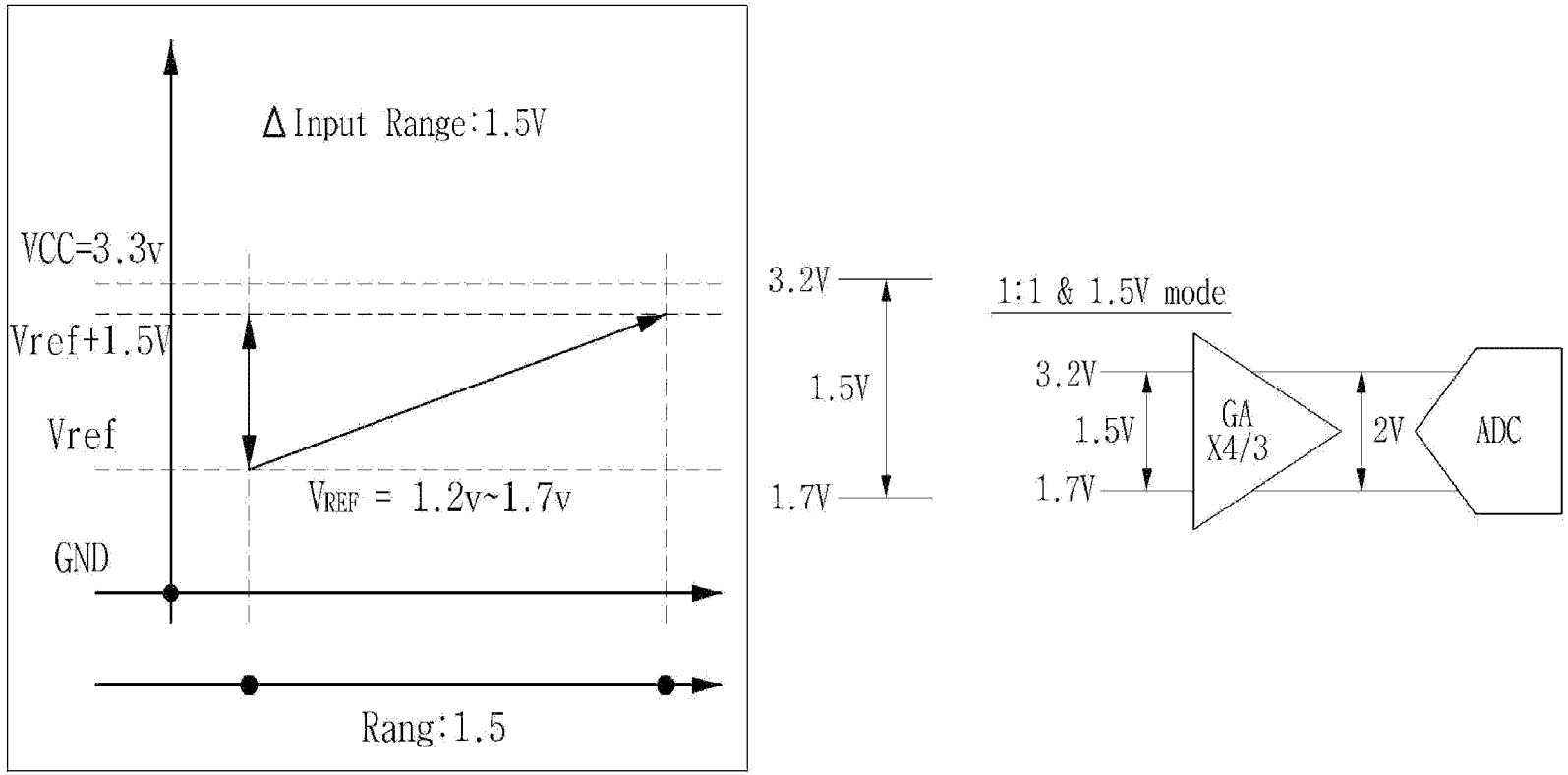
Figure 12:
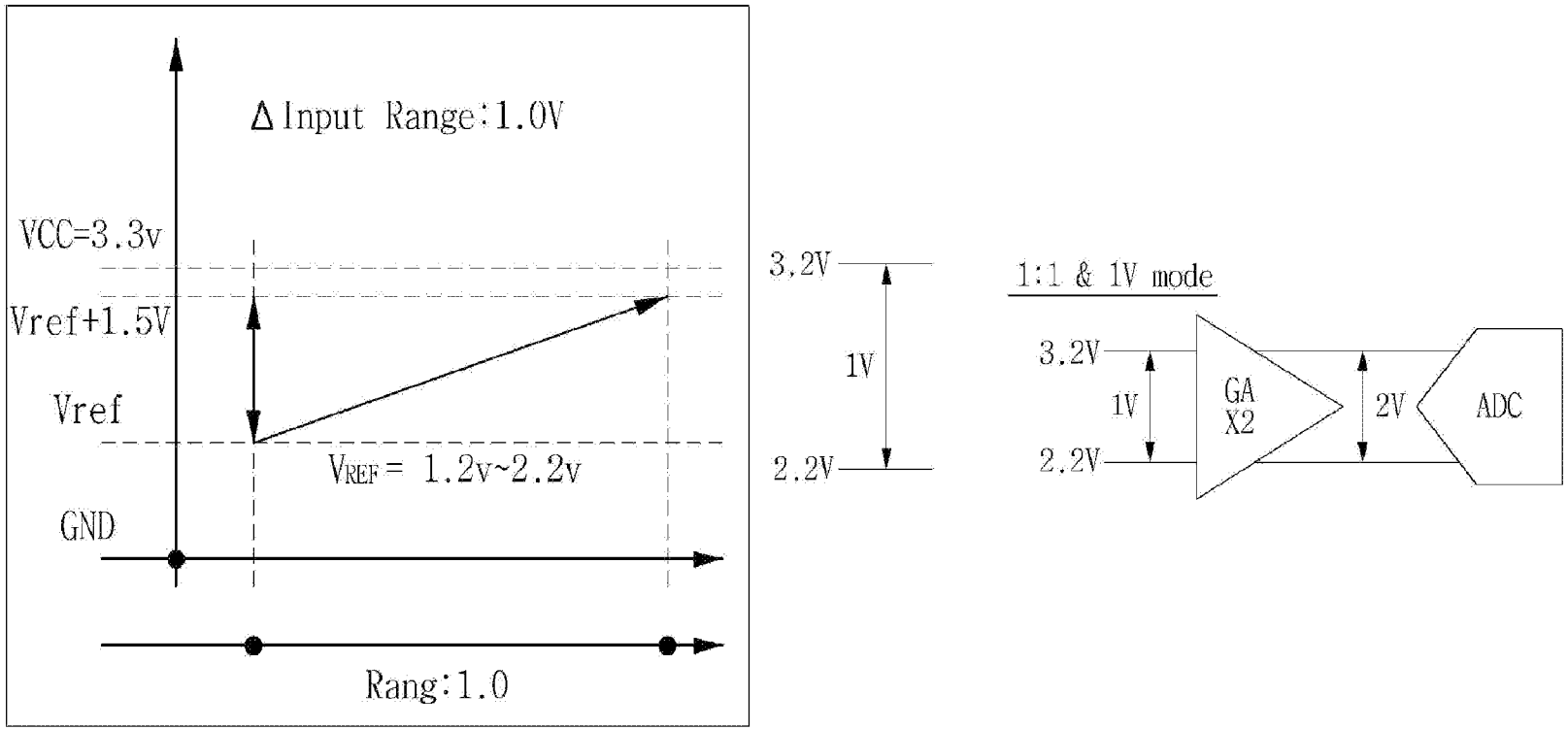

When a threshold voltage of Δ2.7V is transmitted to the sensing voltage input terminal SVT_IN as illustrated in FIG. 10, the operation mode is set to the scale mode, because Δ2.7V is larger than the variation range of Δ1.5V to Δ1.0V. Thus, the following scaling operation is performed.

In the scale mode, since the sensing switch SVT_SEN is turned on, the threshold voltage of Δ2.7V, transmitted to the sensing voltage input terminal SVT_IN, is sampled into the sampling capacitor $C_S$ through the sensing switch SVT_SEN. At this time, a voltage ranging from 1.2V to 2.2V is supplied to the reference voltage source VREF. In the present embodiment, the case in which a voltage of 2V is supplied to the reference voltage source VREF will be taken as an example for description.

After the charge voltage of the charge-share capacitor $C_{CS}$ is reset by a turn-on operation of the reset switch SVT_RST, the charge-share switch SVT_CS is turned on. Thus, the threshold voltage sampled in the sampling capacitor $C_S$ is scaled down by the charge-share capacitor $C_{CS}$. At this time, in order to change the threshold voltage of Δ2.7V, sampled in the sampling capacitor $C_S$, to a threshold voltage of Δ1V, the threshold voltage of Δ2.7V needs to be scaled down through a scale factor of 0.375. The operation of scaling down the threshold voltage through the scale factor of 0.375 may be accomplished by properly setting the capacitance values of the sampling capacitor $C_S$ and the charge-share capacitor $C_{CS}$.

The threshold voltage of Δ1V, scaled down through the above-described process, is outputted to the analog-to-digital conversion unit 300 through the MOS transistor S_CA1.

However, when the threshold voltage of Δ1.5V is transmitted to the sensing voltage input terminal SVT_IN, no scaling operation is required because Δ1.5V falls within the variation range of a threshold voltage to be outputted by the first sample and hold section 210. Thus, the operation mode is set in the bypass mode (1:1 mode) to perform the following operation.

Figure 7:
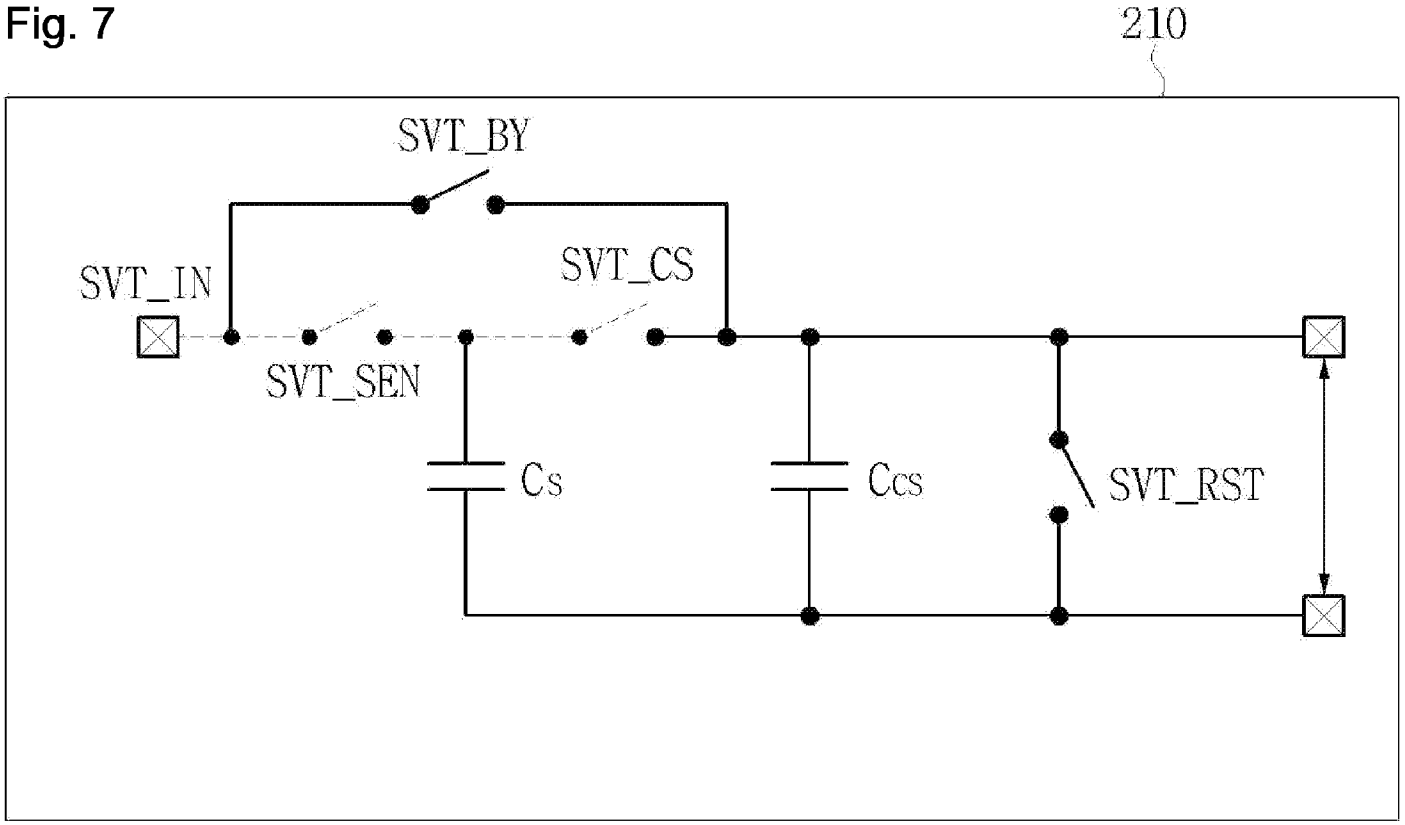

In the bypass mode, the charge voltage of the charge-share capacitor $C_{CS}$ is reset by the turn-on operation of the reset switch SVT_RST. Then, as illustrated in FIG. 7, the bypass switch SVT_BY is turned on to bypass the threshold voltage transmitted to the sensing voltage input terminal SVT_IN to the charge-share capacitor $C_{CS}$ through the bypass switch SVT_BY.

At this time, a voltage ranging from 1.2V to 1.7V is supplied to the reference voltage source VREF. In the present embodiment, the case in which a voltage of 1.7V is supplied to the reference voltage source VREF will be taken as an example for description. The threshold voltage of Δ1.5V, bypassed through the above-described process, is outputted to the analog-to-digital conversion unit 300 through the MOS transistor S_CA1.

Furthermore, when a threshold voltage of Δ1V is transmitted to the sensing voltage input terminal SVT_IN, the operation mode is set to the bypass mode, because Δ1V falls within the variation range of a threshold voltage to be outputted by the first sample and hold section 210. Then, the following operation is performed.

In the bypass mode, the charge voltage of the charge-share capacitor $C_{CS}$ is reset by a turn-on operation of the reset switch SVT_RST. Then, the bypass switch SVT_BY is turned on to bypass the threshold voltage of Δ1V, transmitted to the sensing voltage input terminal SVT_IN, to the charge-share capacitor $C_{CS}$ through the bypass switch SVT_BY.

At this time, a voltage ranging from 1.2V to 2.2V is supplied to the reference voltage source VREF. In the present invention, the case in which a voltage of 2.2V is supplied to the reference voltage source VREF will be taken as an example for description.

The threshold voltage of Δ1V, bypassed through the above-described process, is outputted to the analog-to-digital conversion unit 300 through the MOS transistor S_CA1.

The analog-to-digital conversion unit 300 converts the threshold voltage scaled down or bypassed through the sample and hold unit 200 into a digital signal, and outputs the digital signal. For this operation, the analog-to-digital conversion unit 300 includes an amplification section 310, an analog-to-digital converter (ADC) 320, a latch 330, and a data driver 340 as illustrated in FIG. 5.

The amplification section 310 includes input switches P1_4 to P1_6 and input switches P3_1 and P3_2 for inputting the threshold voltages sampled and held through the first and second sample and hold sections 210 and 220, a capacitor $C_{CSP}$, a MOS transistor P2, an amplifier 311 for amplifying the input threshold voltages, capacitors $C_{85}$ to $C_{88}$ for adjusting the amplification factor of the amplifier 311, and feedback switches P4_1 and P4_2. The amplifier 311 includes two input terminals and two output terminals, in order to amplify the threshold voltages outputted from the first and second sample and hold sections 210 and 220.

As described above, the amplification section 310 amplifies and outputs the threshold voltages outputted from the first and second sample and hold units 210 and 220. However, the following descriptions will be focused on the case in which the amplification section 310 amplifies and outputs the threshold voltage outputted from the first sample and hold section 210.

In the scale mode or bypass mode, when a threshold voltage of Δ1.5V is sampled and held by the first sample and hold section 210, the fourth-first feedback switch P4_1 is turned on. Thus, the first and second capacitors $C_{S5}$ and $C_{S6}$ are coupled in parallel to each other between input and output terminals at one side of the amplifier 311. Therefore, the amplifier 311 amplifies the threshold voltage of Δ1.5V, inputted from the first sample and hold section 210 through the switch P3_1, at an amplification factor of 4/3 using the first and second capacitors $C_{S5}$ and $C_{S6}$ coupled in parallel to each other, and outputs the changed threshold voltage of Δ2V to the ADC 320 (refer to FIGS. 9 and 11).

In the scale mode or bypass mode, when a threshold voltage of Δ1V is sampled and held by the first sample and hold section 210, the fourth-first feedback switch P4_1 is turned off. Thus, the first capacitor $C_{S5}$ is solely coupled between the input and output terminals at one side of the amplifier 311. Therefore, the amplifier 311 amplifies the threshold voltage of Δ1V, inputted from the first sample and hold section 210 through the third-first input switch P3_1, at an amplification factor of 2 using the capacitor $C_{S5}$, and outputs the changed threshold voltage of Δ2V to the analog-to-digital conversion unit 320 (refer to FIGS. 10 and 12).

When the capacitance of the capacitor for one-time amplification in the amplifier 311 is set to $C_A$, the capacitance of the capacitor for two-times amplification may be set to $\frac{1}{2}*C_A$, and the capacitance of the capacitor for 4/3-time amplification may be set to $\frac{1}{4}*C_A$.

The analog threshold voltage of Δ2V, outputted from the amplification section 310, is converted into a predetermined-bit digital signal (for example, 10-bit digital signal) by the ADC 320, and latched in the latch 330.

Furthermore, the digital signal latched in the latch 330 is outputted through the data driver 340.

Therefore, when a threshold voltage of Δ4V or 2.7V is inputted to the sample and hold unit 200, the threshold voltage may be scaled down as described above, and when a threshold voltage of Δ1.5 or Δ1V is inputted, the threshold voltage may be bypassed as described above. Then, the threshold voltage may be amplified through the amplification section 310. Thus, even when four kinds of threshold voltages having different variation ranges are inputted as illustrated in FIGS. 9 to 12, an analog threshold voltage having a variation range of 2V may be inputted to the analog-to-digital conversion unit 320.

Figure 13:
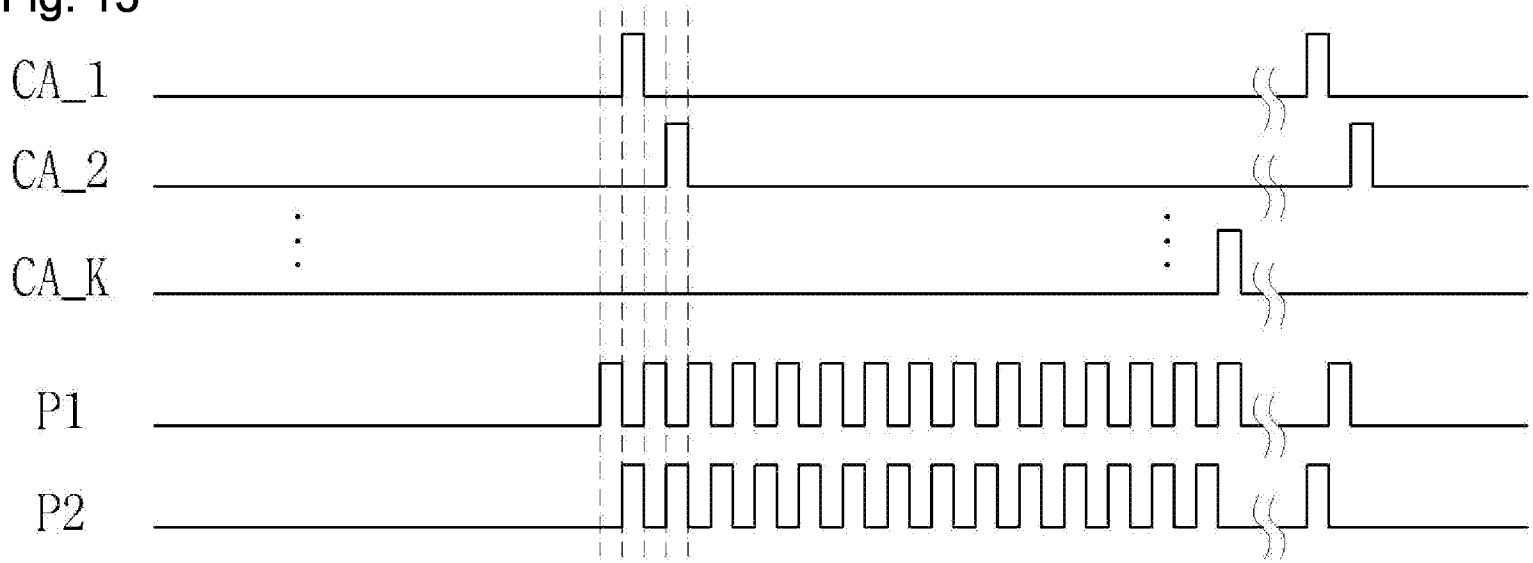
FIG. 13 is an analog-to-digital conversion timing diagram of an analog-to-digital conversion unit of FIG. 5.

FIG. 13 is a timing diagram of the analog-to-digital conversion unit 300. In FIG. 13, CA_1 to CA_K represent the output timings of threshold voltages supplied to the ADC 320 from a predetermined number of sample and hold units (for example, 240 sample and hold units), P1 represents the reset timing of the amplifier 311, and P2 represents the timing of the reference voltage supplied to the amplifier 311. As illustrated in FIG. 13, the reference voltage may be supplied in synchronization with the output timings of the threshold voltages.

Figure 14:
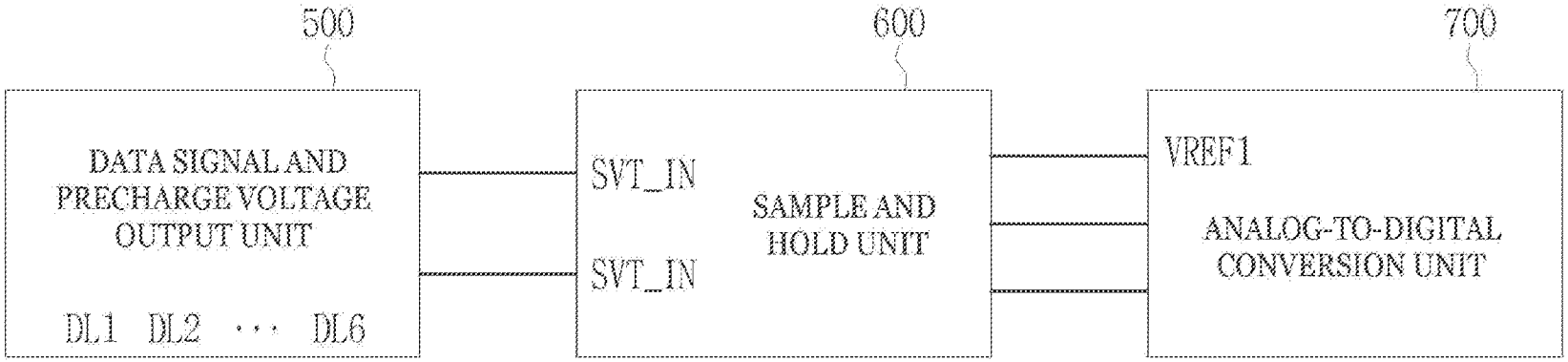
FIG. 14 is the entire block diagram of a threshold voltage sensing circuit of an OLED display device according to a second embodiment of the present invention.
Figure 15:
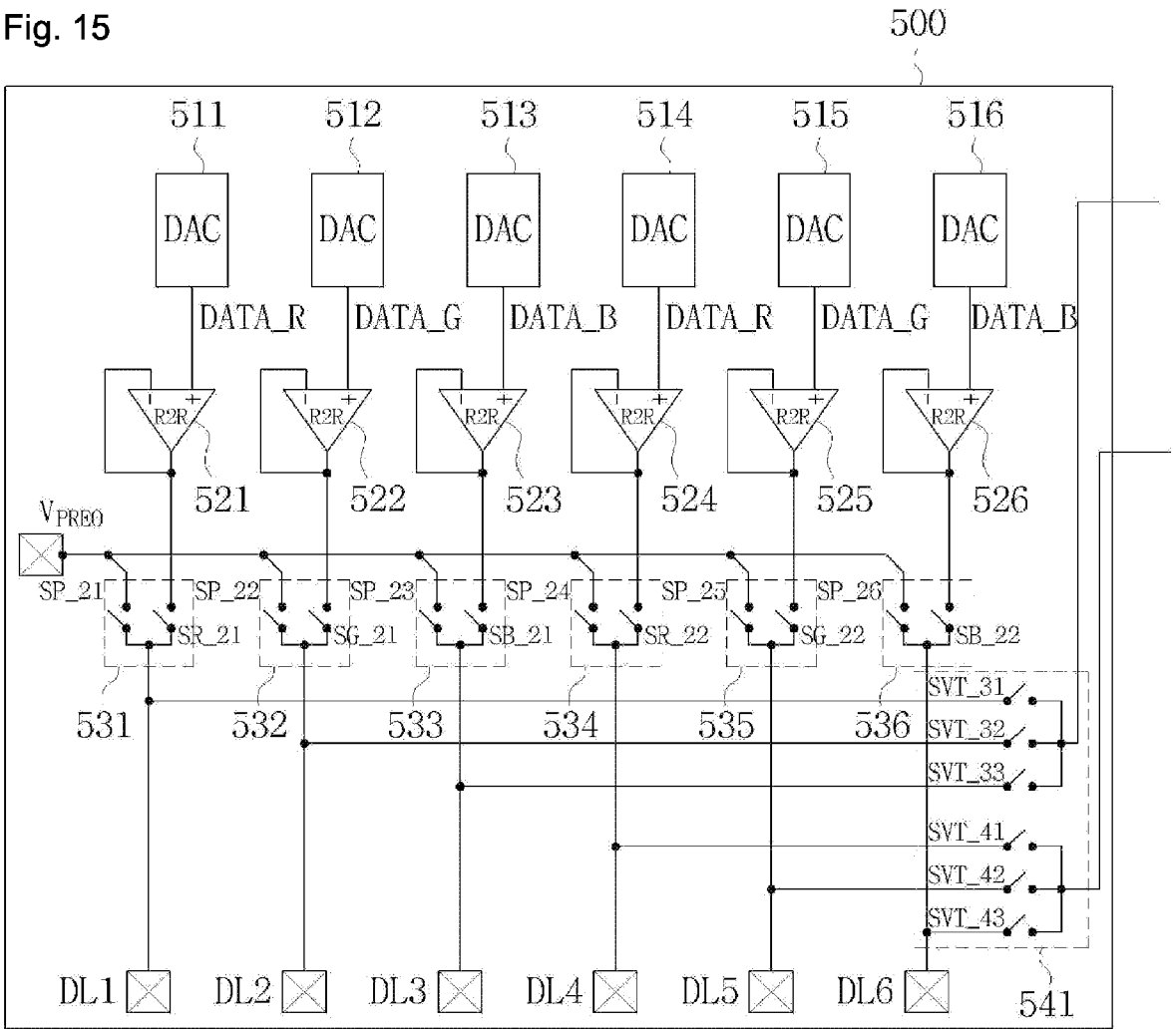
FIGS. 15 to 17 are detailed circuit diagrams of respective units of FIG. 14.

FIG. 14 is a circuit diagram of a threshold voltage sensing circuit of an OLED display device according to a second embodiment of the present invention. As illustrated in FIG. 14, the threshold voltage sensing circuit includes a data signal and precharge voltage output unit 500, a sample and hold unit 600, and an analog-to-digital conversion unit 700.

The installation positions of the data signal and precharge voltage output unit 500, the sample and hold unit 600, and the analog-to-digital conversion unit 700 are not limited, but may be installed within a source driver.

The data signal and precharge voltage output unit 500 includes first to sixth DACs 511 to 516, first to sixth buffers 521 to 526, first to sixth switch sections 531 to 536, and a threshold voltage sensing switch section 541.

In the image display mode for a display panel, the first DAC 511 and the fourth DAC 514 output a red data signal DATA_R, the second DAC 512 and the fifth DAC 515 output a green data signal DATA_G, and the third DAC 513 and the sixth DAC 516 output a blue data signal DATA_B.

Each of the first to sixth buffers 521 to 526 buffers and outputs the corresponding data signal among the red, green, and blue data signals DATA_R, DATA_G, and DATA_B outputted from the first to sixth DACs 511 to 516.

The first to sixth switch sections 531 to 536 include switches SP_21 and SR_21, switches SP_22 and SG_21, switches SP_23 and SB_21, switches SP_24 and SR_22, switches SP_25 and SG_22, and switches SP_26 and SB_22, respectively. The first switch section 531 selects and outputs the red data signal DATA_R through the second-first red switch SR_21 in the image display mode, and selects and outputs a threshold voltage detection precharge voltage $V_{PRE0}$ through the second-first output switch SP_21 in the threshold voltage sensing mode. The second switch section 532 selects and outputs the green data signal DATA_G through the second-first green switch SG_21 in the image display mode, and selects and outputs the threshold voltage detection precharge voltage $V_{PRE0}$ through the second-second output switch SP_22 in the threshold voltage sensing mode. The third switch section 533 selects and outputs the blue data signal DATA_B through the second-first blue switch SB_21 in the image display mode, and selects and outputs the threshold voltage detection precharge voltage $V_{PRE0}$ through the second-third output switch SP_23 in the threshold voltage sensing mode. The fourth switch section 534 selects and outputs the red data signal DATA_R through the second-second blue switch SR_22 in the image display mode, and selects and outputs the threshold voltage detection precharge voltage $V_{PRE0}$ through the second-fourth output switch SP_24 in the threshold voltage sensing mode. The fifth switch section 535 selects and outputs the green data signal DATA_G through the second-second green switch SG_22 in the image display mode, and selects and outputs the threshold voltage detection precharge voltage $V_{PRE0}$ through the second-fifth output switch SP_25 in the threshold voltage sensing mode. The sixth switch section 536 selects and outputs the blue data signal DATA_B through the second-second blue switch SB_22 in the image display mode, and selects and outputs the threshold voltage detection precharge voltage $V_{PRE0}$ through the second-sixth output switch SP_26 in the threshold voltage sensing mode.

The threshold voltage sensing switch section 541 includes a plurality of threshold voltage sensing switches SVT_31 to SVT_33 and SVT_41 to SVT_43. The third-first threshold voltage sensing switch SVT_31 selects and outputs a threshold voltage sensed from an arbitrary red OLED coupled to a first data line DL1. The third-second threshold voltage sensing switch SVT_32 selects and outputs a threshold voltage sensed from an arbitrary green OLED coupled to a second data line DL2. The third-third threshold voltage sensing switch SVT_33 selects and outputs a threshold voltage sensed from an arbitrary blue OLED coupled to a third data line DL3. The fourth-first threshold voltage sensing switch SVT_41 selects and outputs a threshold voltage sensed from an arbitrary red OLED coupled to a fourth data line DL4. The fourth-second threshold voltage sensing switch SVT_42 selects and outputs a threshold voltage sensed from an arbitrary green OLED coupled to a fifth data line DL5. The fourth-third threshold voltage sensing switch SVT_43 selects and outputs a threshold voltage sensed from an arbitrary blue OLED coupled to a sixth data line DL6.

The method of selecting a threshold voltage sensed from an OLED arranged in each horizontal line on the display panel and transmitting the selected threshold voltage to the sample and hold unit 600 may be implemented in various manners, and the present invention is not limited to a specific method. In the second embodiment of the present invention, a pair of threshold voltages among the threshold voltages for red, green, and blue may be selected through the threshold voltage sensing switches SVT_31 to SVT_33 and SVT_41 to SVT_43, and then transmitted to the sample and hold unit 600.

For example, when the third-first threshold voltage sensing switch SVT_31 selects and outputs a threshold voltage sensed from an arbitrary red OLED coupled to the first data line DL1, the fourth-first threshold voltage sensing switch SVT_41 may select and output a threshold voltage sensed from an arbitrary red OLED coupled to the fourth data line DL4.

The sample and hold unit 600 includes first and second sample and hold sections 610 and 620 having the same configuration, in response to a pair of threshold voltages inputted from the data signal and precharge voltage output unit 500. In the present embodiment, the first sample and hold section 610 will be taken as an example for description.

The first sample and hold section 610 includes a sensing switch SMP, a second reference voltage switch SVR2, a sampling capacitor $C_S$, a first charge-share switch S_CS1, a first reference voltage switch SVR1, a first charge-sharing operation switch SCAP1, a first charge-share capacitor $C_{CS1}$, a second charge-sharing operation switch SCAP2, a second charge-share capacitor $C_{CS2}$, a reset switch RST1, a second charge-share switch S_CS2, a second reference voltage source VREF2, and a first reference voltage source VREF1.

The sensing switch SMP is coupled between a sensing voltage input terminal SVT_IN and one terminal of the sampling capacitor $C_S$, and transmits a threshold voltage sensed from an OLED of the display panel to the sampling capacitor $C_S$. The second reference voltage switch SVR2 is coupled between the second reference voltage source VREF2 and the other terminal of the sampling capacitor $C_S$, and transmits the voltage of the second reference voltage source VREF2 to the other terminal of the sampling capacitor $C_S$. The sampling capacitor $C_S$ is coupled between the other terminal of the sensing switch SMP and the other terminal of the second reference voltage switch SVR2, and samples the threshold voltage inputted through the sensing switch SMP. The first charge-share switch S_CS1 is coupled to one terminal of the sampling capacitor $C_S$. The first reference voltage switch SVR1 is coupled between the other terminal of the second reference voltage switch SVR2 and the other terminal of the first charge-share capacitor $C_{CS1}$, and transmits the voltage of the second reference voltage source VREF2 to the first and second charge-share capacitors $C_{CS1}$ and $C_{CS2}$. The first charge-sharing operation switch S_CAP1 is coupled between the other terminal of the first charge-share switch S_CS1 and one terminal of the first charge-share capacitor $C_{CS1}$, and determines whether to enable the charge-sharing operation of the first charge-share capacitor $C_{CS1}$. The first charge-share capacitor $C_{CS1}$ is coupled between the other terminal of the first charge-sharing operation switch S_CAP1 and the other terminal of the first reference voltage switch SVR1, and charge-shares the threshold voltage sampled in the sampling capacitor $C_S$. The second charge-sharing operation switch S_CAP2 is coupled between the other terminal of the first charge-share switch S_CS1 and one terminal of the second charge-share capacitor $C_{CS2}$, and determines whether to enable the charge-sharing operation of the second charge-share capacitor $C_{CS2}$. The second charge-share capacitor $C_{CS2}$ is coupled between the other terminal of the second charge-sharing operation switch S_CAP2 and the other terminal of the first reference voltage switch SVR1, and charge-shares the threshold voltage sampled in the sampling capacitor $C_S$. The reset switch RST1 is coupled between the other terminal of the first charge-share switch S_CS1 and the other terminal of the first reference voltage switch SVR1, and resets the threshold voltages stored in the first and second charge-share capacitors $C_{CS1}$ and $C_{CS2}$. The second charge-share switch S_CS2 is coupled between the other terminal of the first charge-share switch S_CS1 and an input terminal of the analog-to-digital conversion unit 700, and transmits the threshold voltages stored in the first and second charge-share capacitors $C_{CS1}$ and $C_{CS2}$ to the input terminal. When the first sample and hold section 610 samples and holds threshold voltages sensed and inputted from arbitrary OLEDs on the display panel through the data signal and precharge voltage output unit 500 and outputs the sampled and held threshold voltages to the analog-to-digital conversion unit 700 at the next stage, the first sample and hold section 610 may scale down the threshold voltages having a range of a reference value or more (for example, 2 or more) into threshold voltages having a range of a predetermined value or less (for example, the minimum integer 1 or less).

For example, when a threshold voltage having a variation range of 3V (Δ3V) or 2V (Δ2V) is inputted to the first sample and hold section 610, the first sample and hold section 610 may scale downs the threshold voltage to a threshold voltage of Δ1V through charge sharing. When a threshold voltage of Δ1V is inputted, the first sample and hold section 610 may not perform the charge-sharing operation, but bypass the threshold voltage. Such a process will be described below with reference to FIGS. 18 to 22.

First, a precharge and sensing operation is performed on the OLEDs of the display panel.

At this time, when a threshold voltage having a variation range of 3V (Δ3V), for example, one of a threshold voltage ranging from 2V to 5V, a threshold voltage ranging from 3V to 6V, a threshold voltage ranging from 4V to 7V, and a threshold voltage ranging from 5V to 8V as illustrated in FIG. 21A is transmitted to the sensing voltage input terminal SVT_IN of the first sample and hold section 610 through any one of the threshold voltage sensing switches SVT_31 to SVT_33 in the threshold voltage sensing switch section 541 of the data signal and precharge output unit 500, the threshold voltage may be scaled down to a threshold voltage having a variation range of Δ1V, that is, one of a threshold voltage ranging from 2V to 3V, a threshold voltage ranging from 3V to 4V, a threshold voltage ranging from 4V to 5V, and a threshold voltage ranging from 5V to 6V by a controller (not illustrated) through the following process. The scaling process will be described with reference to FIG. 18.

First, the first and second charge-sharing operation switches S_CAP1 and S_CAAP2 and the reset switch RST1 are turned on. Thus, voltages remaining in the first and second charge-share capacitors $C_{CS1}$ and $C_{CS2}$ are discharged by the reset switch RST1. At this time, the second reference voltage switch SVR2 is turned on to supply the voltage of the second reference voltage source VREF2 to the other terminal of the sampling capacitor $C_S$ through the second reference voltage switch SVR2.

Subsequently, the sensing switch SMP is turned on to sample a threshold voltage of Δ3V, inputted through the sensing voltage input terminal SVT_IN, into the sampling capacitor $C_S$. Thus, the threshold voltage sampled in the sampling capacitor $C_S$ may have a potential obtained by adding the threshold voltage of Δ3V to the voltage of the second reference voltage source VREF2.

According to a user's request, a voltage range to be sensed may be set to a packet, and a threshold voltage may be sensed through the above-described process. Then, the voltage of the second reference voltage source EVREF2 may be set to a proper value ranging from 2V to 5V, for example, such that the sensed threshold voltage falls within the range of a target threshold voltage.

Then, the second reference voltage switch SVR2 and the sensing switch SMP are turned off, and the first reference voltage switch SVR1 and the first charge-share switch S_SC1 are turned on. Thus, the sampling capacitor $C_S$ and the first and second charge-share capacitors $C_{CS1}$ and $C_{CS2}$ are coupled in parallel to each other. Therefore, the voltage sampled in the sampling capacitor $C_S$ is charge-shared by the first and second charge-share capacitors $C_{CS1}$ and $C_{CS2}$, and reduced to ⅓. That is, the threshold voltage of Δ3V is scaled down to a threshold voltage of Δ1V. At this time, in order to convert the sensed high-voltage level into a low-voltage level of the amplifier 711 of the analog-to-digital conversion unit 700, the voltage of the first reference voltage source VREF1 is supplied to the sampling capacitor $C_S$ and the first and second charge-share capacitors $C_{CS1}$ and $C_{CS2}$.

Figure 16:
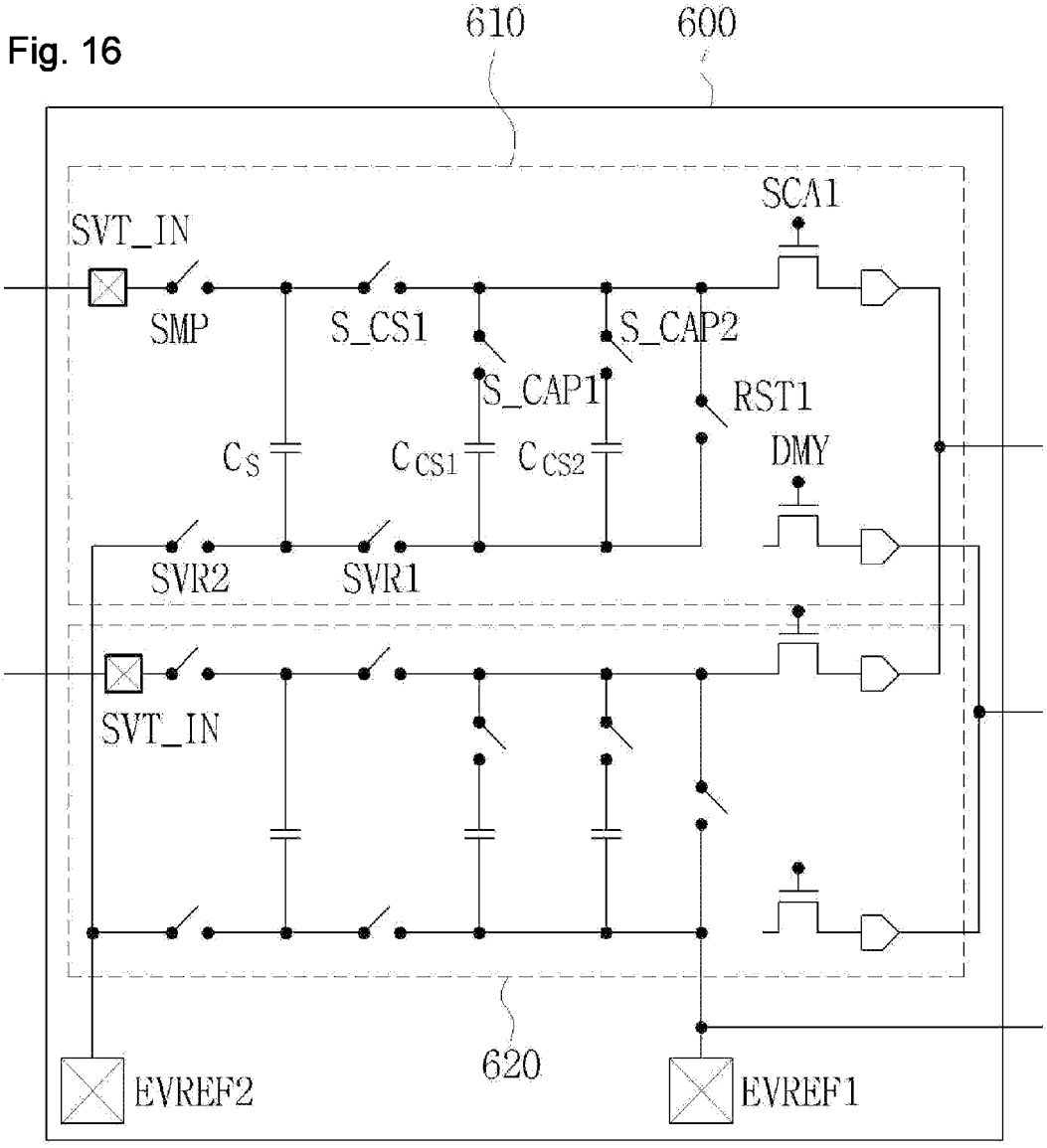
Figure 17:
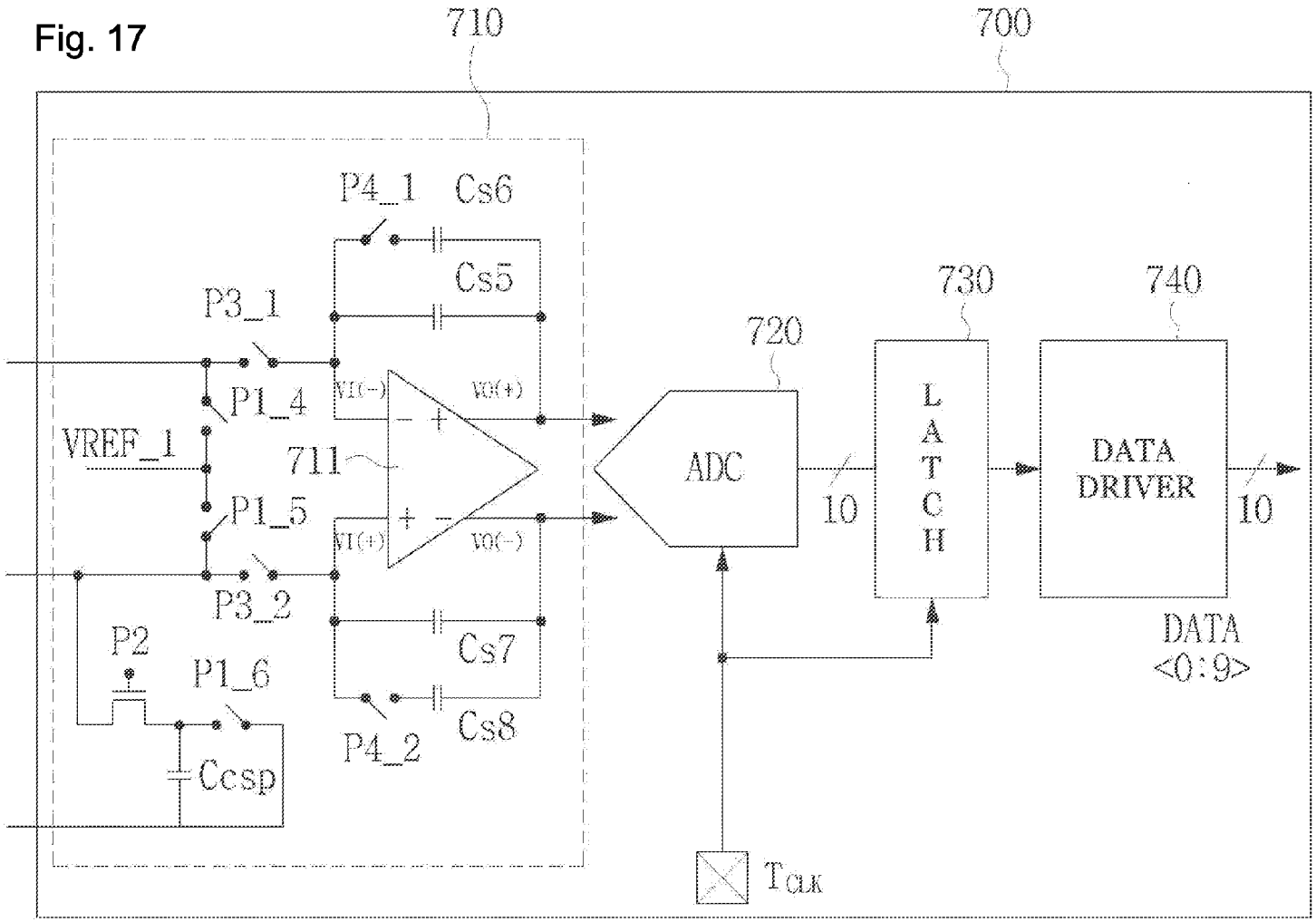
Figure 18:
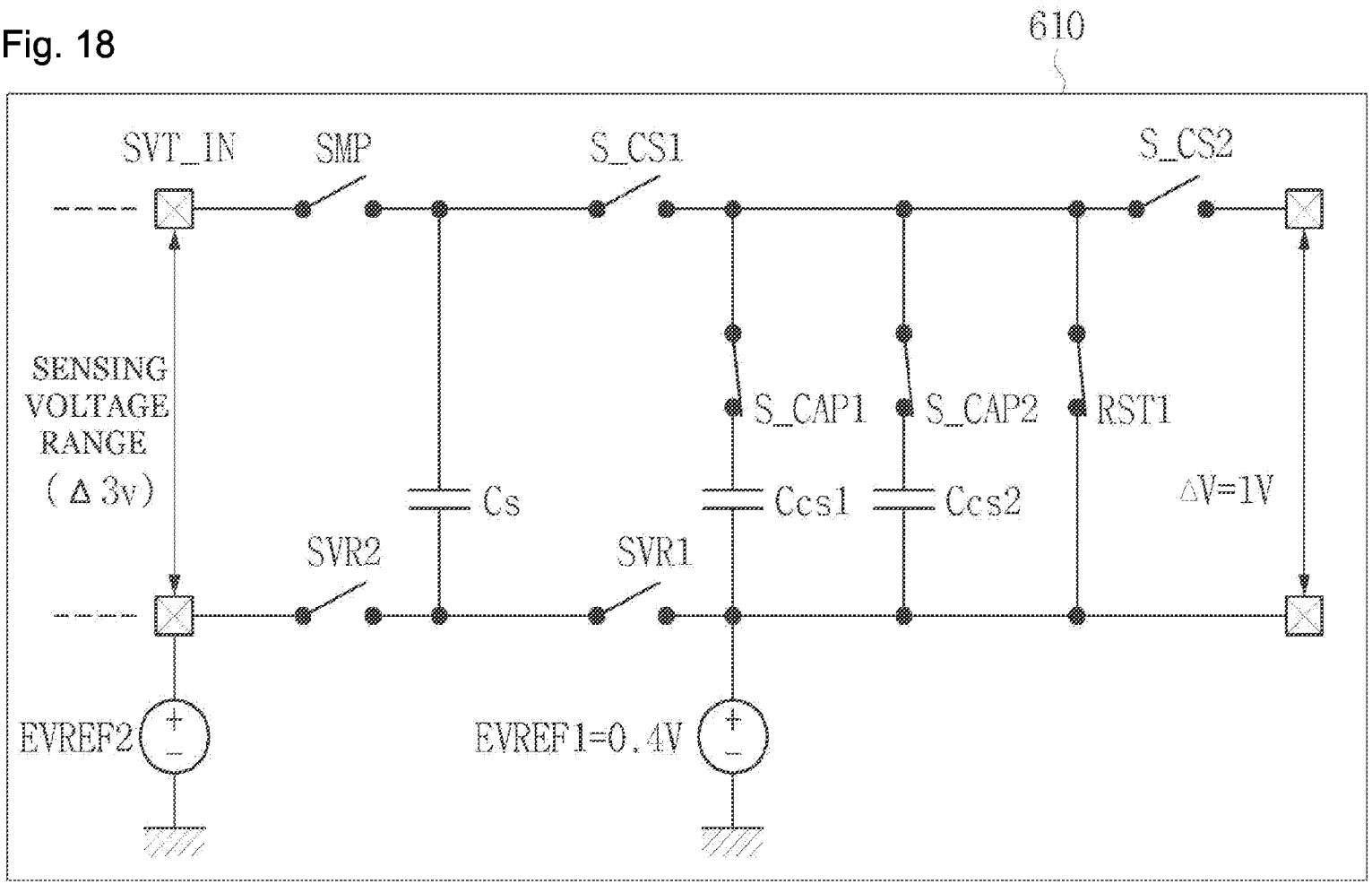
FIGS. 18 to 20 are circuit diagrams for explaining the operation of a first sample and hold section of FIG. 16.
Figure 19:
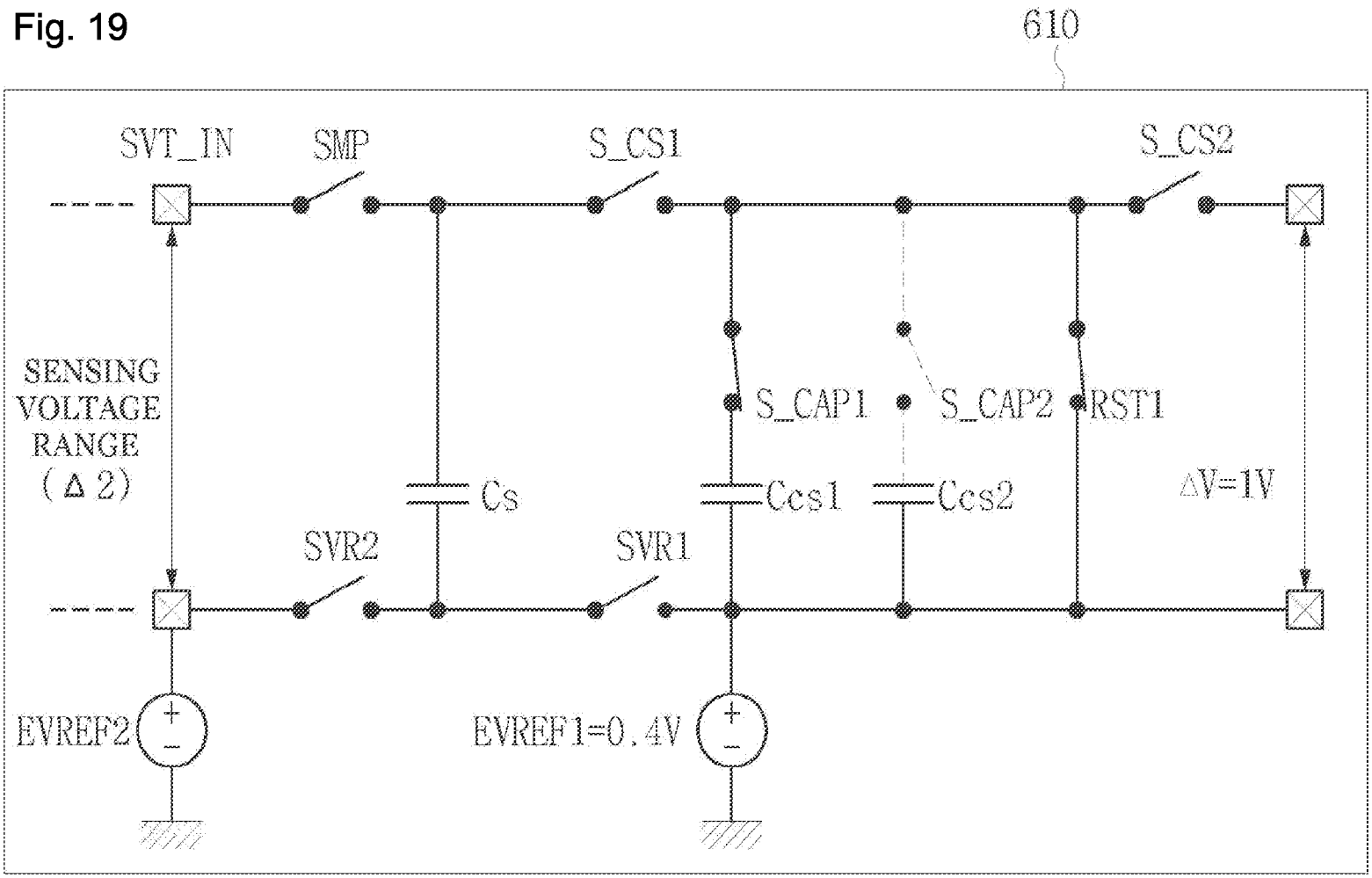
Figure 20:
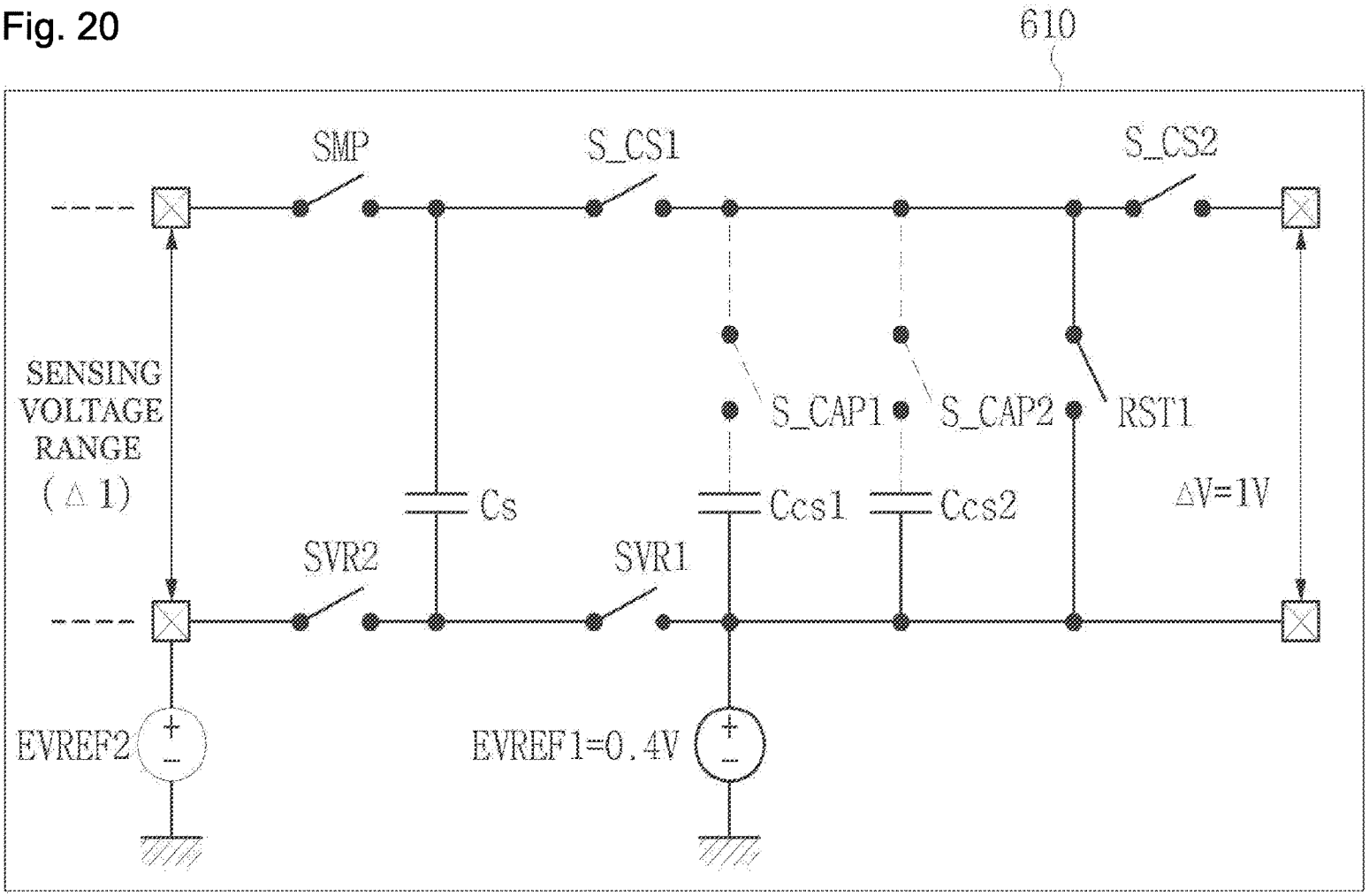
Figure 22:
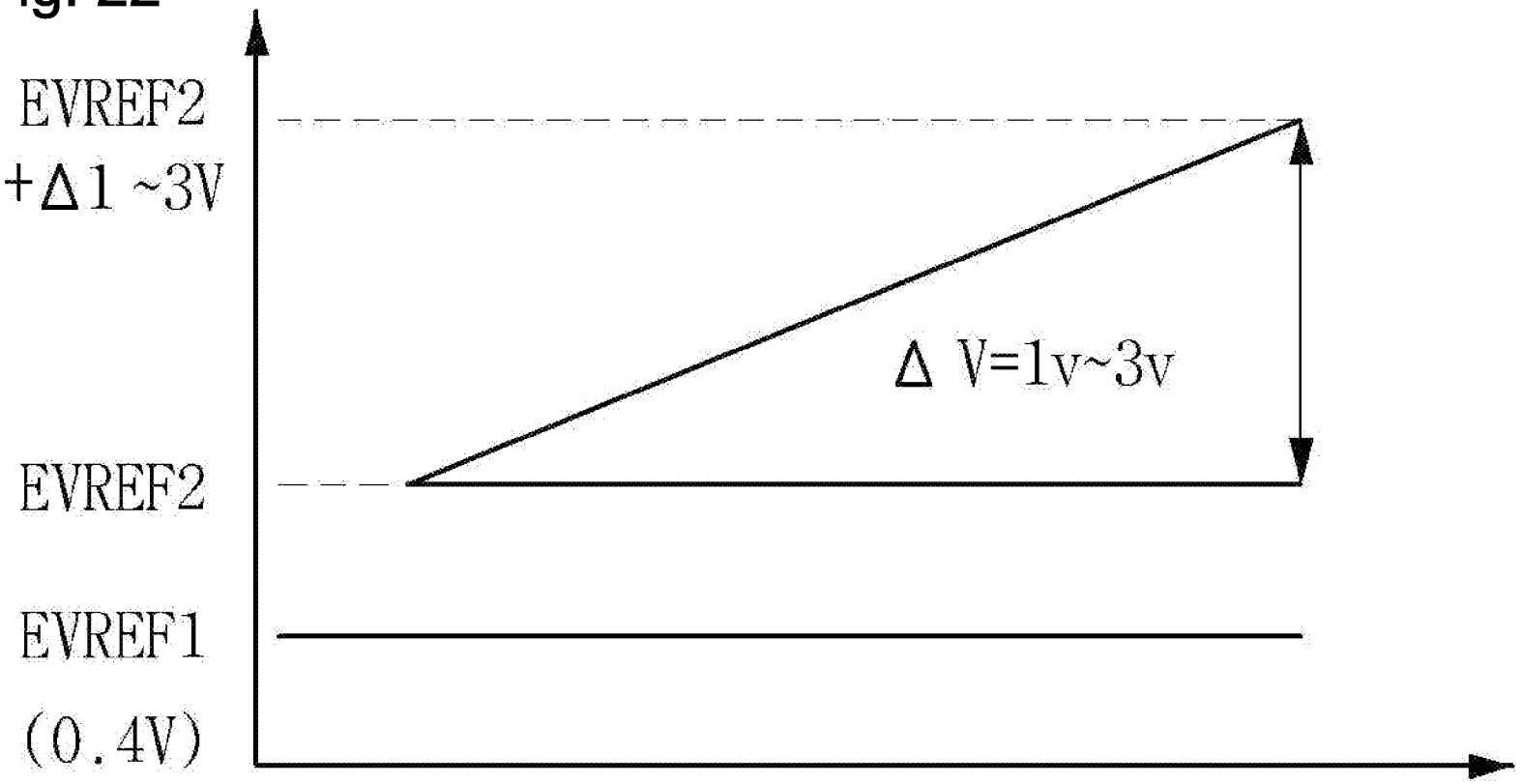
FIG. 22 is a diagram illustrating a range of sensed and inputted threshold voltages in the second embodiment of the present invention.

The threshold voltage of Δ1V, reduced to ⅓ as described above, is transmitted to the analog-to-digital conversion unit 700 at the next stage through the second charge-share switch S_CS2. The second charge-share switch S_CS2 illustrated in FIGS. 18 to 20 may be implemented with various types of switching elements, and FIG. 16 illustrates an example in which the second charge-share switch S_CS2 is implemented with a MOS transistor.

When a threshold voltage of Δ2V, for example, one of a threshold voltage ranging from 2V to 4V, a threshold voltage ranging from 3V to 5V, a threshold voltage ranging from 4V to 6V, and a threshold voltage ranging from 5V to 7V as illustrated in FIG. 21B is transmitted to the sensing voltage input terminal SVT_IN of the first sample and hold section 610, the threshold voltage is scaled down to a threshold voltage of Δ1V, for example, one of a threshold voltage ranging from 2V to 3V, a threshold voltage ranging from 3V to 4V, a threshold voltage ranging from 4V to 5V, and a threshold voltage ranging from 5V to 6V is scaled down, and then outputted. The scaling process will be described with reference to FIG. 19.

The process of scaling down the threshold voltage of Δ2V to the threshold voltage of Δ1V is similar to the process of scaling down the threshold voltage of Δ3V to the threshold voltage of Δ1V. However, the process of scaling down the threshold voltage of Δ2V to the threshold voltage of Δ1V is different from the process of scaling down the threshold voltage of Δ3V to the threshold voltage of Δ1V in that the second reference voltage source VREF2 is set in the range of 2V to 6V, one of the first and second charge-sharing operation switches S_CAP1 and S_CAP2, for example, the first charge-sharing operation switch S_CAP1 is turned on, the second charge-sharing operation switch S_CAP2 is turned off, and the voltage sampled in the sampling capacitor $C_S$ is scaled down to ½ by the first charge-sharing operation switch S_CAP1.

When a threshold voltage having a variation range of 1V (Δ1V), for example, one of a threshold voltage ranging from 2V to 3V, a threshold voltage ranging from 3V to 4V, a threshold voltage ranging from 4V to 5V, a threshold voltage ranging from 5V to 6V, and a threshold voltage ranging from 7V to 8V as illustrated in FIG. 21C is transmitted to the sensing voltage input terminal SVT_IN of the first sample and hold section 610, the above-described scaling process is not performed, and the threshold voltage is bypassed. This process will be described with reference to FIG. 20.

The largest difference between the process of bypassing the threshold voltage of Δ1V and the process of scaling down the threshold voltage of Δ3V to the threshold voltage of Δ1V is that both of the first and second charge-sharing operation switches S_CAP1 and S_CAP2 are turned off and no scaling operation is performed. Furthermore, the voltage of the second reference voltage source VREF2 is set in the range of 2V to 7V.

Then, the analog-to-digital conversion unit 700 processes the threshold voltage of Δ1V, scaled down or bypassed by the sample and hold unit 600 through the above-described process, in the same manner as the analog-to-digital conversion unit 300 of FIG. 2, and outputs the corresponding digital signal.

According to the embodiments of the present invention, when the threshold voltage of the OLED display panel is sensed and transmitted to the ADC, the threshold voltage may be scaled down to threshold voltages within a predetermined range through charge sharing. Thus, the low-voltage driving elements within the ADC may be protected, and the OLEDs may maintain constant brightness.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. A threshold voltage sensing circuit of an OLED display device including an OLED, comprising:

a sampling capacitor configured to sample a threshold voltage of the OLED;

a charge-share capacitor configured to charge-share the voltage sampled in the sampling capacitor;

an amplification unit configured to amplify the threshold voltage outputted from the charge-share capacitor;

a sensing switch coupled between one terminal of the sampling capacitor and a sensing voltage input terminal to which the threshold voltage is inputted;

a second reference voltage switch coupled between the other terminal of the sampling capacitor and one terminal of a second reference voltage source for supplying a second reference voltage;

a charge-share switch having one terminal coupled to the one terminal of the sampling capacitor;

a first reference voltage switch having one terminal coupled to the other terminal of the sampling capacitor and the other terminal commonly coupled to a first reference voltage source for supplying the first reference voltage and the other terminal of the charge-share capacitor;

a charge-sharing operation switch having one terminal coupled to the one terminal of the charge-share capacitor and the other terminal coupled to the other terminal of the charge-share switch; and a comparator configured to compare a variation range of the threshold voltage to a reference value, wherein when the variation range of the threshold voltage is larger than the reference value, the threshold voltage is stored in the sampling capacitor and the charge-share capacitor to make the variation range of the threshold voltage smaller than the reference value, and then transmitted to the amplification unit, wherein when the variation range of the threshold voltage is smaller than the reference value, the threshold voltage is stored in the sampling capacitor.

2. The threshold voltage sensing circuit of claim 1, wherein the amplification unit comprises:

an amplifier configured to amplify the threshold voltage outputted from the charge-share capacitor;

a first capacitor coupled between input and output terminals of the amplifier; and a second capacitor selectively coupled in parallel to the first capacitor so as to adjust an amplification factor of the amplifier.

3. The threshold voltage sensing circuit of claim 2, further comprising a switch configured to selectively couple the second capacitor in parallel to the first capacitor.

4. The threshold voltage sensing circuit of claim 1, wherein when the variation range of the threshold voltage is smaller than the reference value, the sampling capacitor is blocked, and the threshold voltage is stored in the charge-share capacitor and transmitted to the amplification unit as it is.

5. A threshold voltage sensing circuit of an OLED display device including an OLED, comprising:

a sampling capacitor configured to sample a threshold voltage of the OLED;

one or more charge-share capacitors configured to charge-share the voltage sampled in the sampling capacitor;

a sensing switch coupled between one terminal of the sampling capacitor and a sensing voltage input terminal to which the threshold voltage is inputted;

a second reference voltage switch coupled between the other terminal of the sampling capacitor and one terminal of a second reference voltage source for supplying a second reference voltage;

a charge-share switch having one terminal coupled to the one terminal of the sampling capacitor;

a first reference voltage switch having one terminal coupled to the other terminal of the sampling capacitor and the other terminal commonly coupled to a first reference voltage source for supplying the first reference voltage and the other terminal of the one or more charge-share capacitor;

a charge-sharing operation switch having one terminal coupled to the one terminal of the one or more charge-share capacitor and the other terminal coupled to the other terminal of the charge-share switch; and a comparator configured to compare a variation range of the threshold voltage to a reference value, wherein when the variation range of the threshold voltage is larger than the reference value, the threshold voltage is stored in the sampling capacitor and the one or more charge-share capacitor to make the variation range of the threshold voltage smaller than the reference value, wherein when the variation range of the threshold voltage is smaller than the reference value, the threshold voltage is stored in the sampling capacitor.

6. The threshold voltage sensing circuit of claim 5, further comprising a pair of circuits including another sampling capacitor having the same function as the sampling capacitor and another charge-share capacitor having the same function as the charge-share capacitor.

7. The threshold voltage sensing circuit of claim 5, wherein when the variation range of the threshold voltage is larger than 2V, the variation range of the threshold voltage is scaled down to a range of 1V to 1.5V, and when the variation range of the threshold voltage is 1V to 1.5V, the threshold voltage is bypassed as it is.

8. The threshold voltage sensing circuit of claim 5, wherein a second reference voltage is supplied to the sampling capacitor, and a first reference voltage lower than the second reference voltage is supplied to the one or more charge-share capacitors.

9. The threshold voltage sensing circuit of claim 5, wherein the one or more charge-share capacitors comprises:

a first charge-share capacitor coupled in parallel to the sampling capacitor; and a second charge-share capacitor coupled in parallel to the first charge-share capacitor.

10. The threshold voltage sensing circuit of claim 9, further comprising:

a second charge-sharing operation switch having one terminal coupled to one terminal of the second charge-share capacitor and the other terminal coupled to the other terminal of the charge-share switch;

a reset switch having one terminal coupled to the other terminal of the charge-share switch and the other terminal coupled to the other terminal of the first reference voltage switch; and a second charge-share switch coupled to the other terminal of the charge-share switch.

11. The threshold voltage sensing circuit of claim 5, wherein when the variation range of the threshold voltage is smaller than the reference value, the one or more charge-share capacitors are blocked, and the threshold voltage is stored in the sampling capacitor and transmitted as it is.

* * * * *